US006939502B2

(12) United States Patent
Lyden

(10) Patent No.: US 6,939,502 B2
(45) **Date of Patent: *Sep. 6, 2005**

(54) METHOD OF MAKING CUSTOM INSOLES AND POINT OF PURCHASE DISPLAY

(76) Inventor: Robert M. Lyden, 18261 SW. Fallatin Loop, Aloha, OR (US) 97007

( * ) Notice: Subject to any disclaimer, the term of this patent is extended or adjusted under 35 U.S.C. 154(b) by 299 days.

This patent is subject to a terminal disclaimer.

(21) Appl. No.: 10/234,508

(22) Filed: Sep. 4, 2002

(65) Prior Publication Data

US 2003/0001314 A1 Jan. 2, 2003

Related U.S. Application Data

(63) Continuation-in-part of application No. 09/570,171, filed on May 11, 2000, now abandoned, which is a continuation-in-part of application No. 08/862,598, filed on May 23, 1997, now abandoned, which is a continuation of application No. 08/510,433, filed on Aug. 2, 1995, now Pat. No. 5,632,057.

(51) Int. Cl.[7] ..... B29C 35/08

(52) U.S. Cl. ..... 264/496; 12/146 B; 12/146 M; 36/93

(58) Field of Search ..... 264/496; 12/146 B, 12/146 M; 36/93

(56) References Cited

U.S. PATENT DOCUMENTS

| | | | | |
|---|---|---|---|---|
| 2,082,910 A | 9/1937 | Daniels | ..... | 36/71 |
| 2,546,827 A | 3/1951 | Lavinthal | ..... | 36/71 |
| 2,668,133 A | 2/1954 | Brophy et al. | | |
| 3,449,844 A | 6/1969 | Spence | ..... | 36/44 |
| 3,786,580 A | 1/1974 | Dalebout | ..... | 36/119 |
| 3,905,376 A | 9/1975 | Johnson et al. | ..... | 36/154 |
| 4,024,594 A | 5/1977 | Haizinger | ..... | 12/4.2 |
| 4,069,602 A | 1/1978 | Kremer et al. | ..... | 36/45 |
| 4,139,337 A | 2/1979 | David et al. | ..... | 425/2 |

(Continued)

FOREIGN PATENT DOCUMENTS

| | | | | |
|---|---|---|---|---|
| DE | 38 40 130 C1 | 6/1990 | ..... | 156/272.8 |
| JP | 62044429 A | 2/1987 | ..... | 156/272.8 |
| JP | 62062734 A | 3/1987 | ..... | 156/272.8 |
| JP | 62142092 A | 6/1987 | ..... | 156/272.8 |
| WO | WO 98/18386 | 5/1998 | ..... | A61B/5/107 |

OTHER PUBLICATIONS

Int'l Plastics Selector Adhesive Digest, 1995, pp. 21–22, 271–291, and 677–678.

*Primary Examiner*—Allan R. Kuhns
(74) *Attorney, Agent, or Firm*—Westman, Champlin & Kelly, P.A.

(57) ABSTRACT

The present invention teaches a conformable device (20) including a light cure material (37) for customizing a portion of an article of footwear (53) in order to enhance conformance or fit, support, comfort, and cushioning, in partial or complete combination. In particular, a custom conformable device (20) consisting of an insole, or portion thereof, can serve to accommodate the unique anatomical features and characteristics of an individual wearer. Further, the present invention teaches a method of making a conformable device (20) including the use of a light table (120) that can be part a point of purchase display (206), or alternately, the floor (222) of a retail store (220).

30 Claims, 11 Drawing Sheets

U.S. PATENT DOCUMENTS

| | | | | |
|---|---|---|---|---|
| 4,166,088 | A | 8/1979 | Neefe | 264/1.38 |
| 4,183,156 | A | 1/1980 | Rudy | 36/44 |
| 4,203,792 | A | 5/1980 | Thompson | 156/275.5 |
| 4,211,019 | A | 7/1980 | McCafferty | 36/43 |
| 4,219,945 | A | 9/1980 | Rudy | 36/29 |
| 4,236,268 | A | 12/1980 | Bradley et al. | 12/146 S |
| 4,271,606 | A | 6/1981 | Rudy | 36/29 |
| 4,287,250 | A | 9/1981 | Rudy | 428/166 |
| 4,296,053 | A | 10/1981 | Doerer et al. | 264/26 |
| 4,340,626 | A | 7/1982 | Rudy | 428/35 |
| 4,342,158 | A | 8/1982 | McMahon | 36/35 R |
| 4,451,634 | A | 5/1984 | Hatanaka et al. | 528/24 |
| 4,467,053 | A | 8/1984 | Markle | 521/128 |
| 4,512,340 | A | 4/1985 | Buck | 602/2 |
| 4,674,206 | A | 6/1987 | Lyden | 36/88 |
| 4,716,662 | A | 1/1988 | Bar | 36/44 |
| 4,765,411 | A | 8/1988 | Tennant | 168/4 |
| 4,780,486 | A | 10/1988 | Lee et al. | 522/14 |
| 4,817,304 | A | 4/1989 | Parker et al. | 36/114 |
| 4,831,064 | A | 5/1989 | Varaprath et al. | 522/99 |
| 4,861,404 | A | 8/1989 | Neff | 156/272.8 |
| 4,874,640 | A | 10/1989 | Donzis | 36/92 |
| 4,876,806 | A | 10/1989 | Robinson et al. | 36/114 |
| 4,892,895 | A | 1/1990 | Arai et al. | 522/99 |
| 4,906,502 | A | 3/1990 | Rudy | 428/69 |
| 4,923,754 | A | 5/1990 | Lee et al. | 428/429 |
| 4,935,455 | A | 6/1990 | Huy et al. | 522/99 |
| 4,936,029 | A | 6/1990 | Rudy | 36/29 |
| 4,943,613 | A | 7/1990 | Arai et al. | 524/773 |
| 4,946,874 | A | 8/1990 | Lee et al. | 522/14 |
| 4,981,651 | A | 1/1991 | Horng | 422/24 |
| 5,042,100 | A | 8/1991 | Bar et al. | 12/142 N |
| 5,042,176 | A | 8/1991 | Rudy | 36/29 |
| 5,082,873 | A | 1/1992 | Liles | 522/86 |
| 5,083,361 | A | 1/1992 | Rudy | 29/454 |
| 5,084,489 | A | 1/1992 | Liles | 522/84 |
| 5,089,537 | A | 2/1992 | Liles | 522/84 |
| 5,101,580 | A | 4/1992 | Lyden | 36/93 |
| 5,118,722 | A | 6/1992 | Wollmann et al. | 521/137 |
| 5,124,212 | A | 6/1992 | Lee et al. | 428/429 |
| 5,128,880 | A | 7/1992 | White | 364/550 |
| 5,177,120 | A | 1/1993 | Hare et al. | 523/109 |
| 5,180,756 | A | 1/1993 | Rehmer et al. | 522/35 |
| 5,183,599 | A | 2/1993 | Smuckler | 264/22 |
| 5,183,831 | A | 2/1993 | Bielat et al. | 522/33 |
| 5,185,385 | A | 2/1993 | Kanluen et al. | 522/84 |
| 5,187,040 | A | 2/1993 | Mueller-Hess et al. | 430/157 |
| 5,192,387 | A | 3/1993 | Buckley | 156/275.5 |
| 5,203,793 | A | 4/1993 | Lyden | 36/88 |
| 5,206,804 | A | 4/1993 | Thies et al. | 705/27 |
| 5,237,520 | A | 8/1993 | White | 382/154 |
| 5,348,604 | A | 9/1994 | Neff | 156/272.8 |
| 5,422,046 | A | 6/1995 | Tarshiani et al. | 264/1.38 |
| 5,470,892 | A | 11/1995 | Gupta et al. | 522/42 |
| 5,483,759 | A | 1/1996 | Silverman | 36/137 |
| 5,512,371 | A | 4/1996 | Gupta et al. | 428/412 |
| 5,516,468 | A | 5/1996 | Lipscomb et al. | 264/1.38 |
| 5,518,843 | A | 5/1996 | Hara et al. | 430/13 |
| 5,529,728 | A | 6/1996 | Buazza et al. | 264/1.38 |
| 5,543,194 | A | 8/1996 | Rudy | 428/69 |
| 5,579,159 | A | 11/1996 | Ito | 359/487 |
| 5,597,519 | A | 1/1997 | Martin et al. | 264/1.38 |
| 5,632,057 | A | 5/1997 | Lyden | 12/146 B |
| 5,671,055 | A | 9/1997 | Whittlesey et al. | 356/376 |
| 5,686,167 | A | 11/1997 | Rudy | 428/178 |
| 5,689,446 | A | 11/1997 | Sundman et al. | 364/560 |
| 5,741,568 | A | 4/1998 | Rudy | 428/69 |
| 5,753,061 | A | 5/1998 | Rudy | 156/147 |
| 5,753,931 | A | 5/1998 | Borchers et al. | 250/559.22 |
| 5,790,256 | A | 8/1998 | Brown et al. | 356/376 |
| 5,804,830 | A | 9/1998 | Shafir | 250/559.22 |
| 6,163,971 | A | 12/2000 | Humphries, Jr. et al. | 33/515 |
| 6,192,593 | B1 | 2/2001 | Borchers et al. | 33/3 A |
| 6,205,230 | B1 | 3/2001 | Sundman et al. | 382/100 |
| 6,217,695 | B1 | 4/2001 | Goldberg et al. | 156/272.8 |
| 6,289,107 | B1 | 9/2001 | Borchers et al. | 382/100 |
| 6,331,893 | B1 | 12/2001 | Brown et al. | 356/601 |

214
213
210
SIGN
176
117
210
178
178
202
195
117
212
183
53
184
209
186
211
185
182
180
179
206.1
211
181
125
188
189
173
187
129
208
174
172
146
175
197
169
171
142
145
150
140
207
170
112
120

METHOD OF MAKING CUSTOM INSOLES AND POINT OF PURCHASE DISPLAY

CROSS REFERENCE TO RELATED APPLICATIONS

This Application is a Continuation-In-Part of U.S. patent application Ser. No. 09/570,171, filed May 11, 2000 now abandoned, which was a Continuation-In-Part of Ser. No. 08/862,598, filed May 23, 1997, now abandoned, which was a Continuation of Ser. No. 08/510,433, filed Aug. 2, 1995, now U.S. Pat. No. 5,632,057. This Application hereby incorporates by reference and claims priority on all of the aforementioned patent applications and patent in their entirety.

DEFINITIONS

In this patent application, the term "rearfoot" is used to identify the area about the heel portion of the foot substantially containing the heel bones, that is, the calcaneus and talus. The term "forefoot" is used to identify the foot portion about the ball and toes of the foot, that is, the area substantially containing the phalanges, sesamoids, and the distal heads of the metatarsals. The term "midfoot" is used to identify the foot portion located between the forefoot and rearfoot as defined above. The midfoot is then posterior of the distal heads of the metatarsals and anterior of the calcaneus and talus, and substantially includes the cuboid, navicular, cuneiforms, and the base and a substantial portion of the shaft of the metatarsals. The anterior-to-posterior axis is understood to extend in a horizontal orientation generally consistent with the sagittal plane with the toes being anterior and the heel being posterior. The medial-to-lateral axis is understood to extend in a horizontal orientation generally consistent with the frontal plane and perpendicular to and intersecting the anterior-to-posterior axis with medial being consistent with the inner side of the foot proximate the midline of the body, and lateral being consistent with the outer side of the foot. The superior-to-inferior axis is understood to be perpendicular to both the medial-to-lateral axis and the anterior-to-posterior axis, and intersects both at a single point, and is substantially vertical in orientation and generally consistent with a line formed by the intersection of the frontal and sagittal planes with the dorsal aspect of the foot being superior and the plantar aspect of the foot being inferior. The transverse plane is generally horizontal and is consistent with the plane formed by the intersection of the medial-to-lateral axis and anterior-to-posterior axis.

The definition of the word "light" found in *The New Collegiate Dictionary*, published by A. Merriam-Webster, Springfield, Mass., 1979 is provided: "an electromagnetic radiation in the wavelength range including infrared, visible, ultraviolet, and X-rays and traveling in a vacuum with a speed of about 186,281 miles per second; specifically: the part of this range that is visible to the human eye." A representation of the electromagnetic spectrum can be found in *Physics*, by John D. Cutnell and Kenneth W. Johnson, published by John Wiley & Sons, New York, 1989, FIG. 30.6, page 655. However, the specific portion of the electromagnetic spectrum that is relevant to the present application includes ultraviolet and visible light having a wavelength substantially between 280 and 780 nanometers, and in particular, visible light having a wavelength substantially between 400 and 780 nanometers. Accordingly, in this application the word "light" is used to indicate electromagnetic radiation having a wavelength between 400 and 780 nanometers corresponding to the visible light spectrum. It can be advantageous to use natural or artificial visible light having a wavelength between 400 and 780 nanometers, since it is possible for exposure to ultraviolet light to cause injury to skin and eye tissue.

BACKGROUND OF THE INVENTION

Some individuals suffer debilitating podiatric conditions which require the fabrication of prescription orthotics by a medical doctor for remedial relief. Accordingly, it is an object of the present invention to provide a light-cure conformable device and method of making orthotics for use by skilled medical doctors, podiatrists and physical therapists that is fast, easy, effective, and relatively inexpensive relative to existing technologies.

However, many of the problems commonly experienced by the general public with articles of footwear simply result from deficiencies in one or more of the following characteristics: conformance or fit, stability, support, comfort, cushioning and shock absorption. Further, it can be readily understood that these qualities can be interrelated, e.g., the conformance provided by an article of footwear can help to satisfy the additional need or desire to improve cushioning by spacially distributing force applications and reducing shock. Accordingly, it is an object of this invention to provide in partial or complete combination, improved conformance or fit, stability, support, comfort, cushioning and shock absorption in relation to articles of footwear for use by the general public.

Eversion of the foot is sometimes generally referred to as pronation, and in particular, medial rotation of the calcaneus associated with articulation of the sub-talar joint is known as rearfoot pronation, whereas inversion of the foot is commonly referred to as supination. In accordance with the above discussion, it can be readily understood that an object of the present invention is to provide means for supporting and stabilizing a wearer's foot in an attempt to avoid possibly injurious conditions arising from excessive pronation or supination.

Every individual has unique anatomical features and characteristics. A practical problem is posed by the need or desire to accommodate for these individual differences and provide wearers of articles of footwear with custom fit, stability, support, comfort, and enhanced cushioning, whether in partial or complete combination. Heretofore, there have been a number of attempted solutions to this problem which have enjoyed varied success. Obvious merits aside, some of the deficiencies of the prior art will be briefly addressed.

Footwear orthotics prescribed by a medical doctor are sometimes required in certain cases in order to remedy debilitating podiatric conditions. For some individuals, there is no other practical or prudent alternative that will provide remedial relief. However, even footwear orthotics such as U.S. Pat. No. 4,470,782 taught by Robert L. Zimmerman, Jr. et al. take considerable time for a specialist to fabricate and can be relatively expensive. Moreover, prescription orthotics are not normally required for members of the general public to successfully enjoy the use of articles of footwear.

Pre-formed "generic" products such as U.S. Pat. No. 4,677,766 taught by Charles J. Gudas can accommodate a greater, or lesser number of individuals depending upon the degree to which characteristic norms corresponding to the target population have been incorporated in the design of such products. In particular, foam materials of select shape have been used to partially accommodate for anatomical differences and enhance the conforming properties of articles of footwear. However, as every individual possesses different anatomical features and characteristics, a preformed generic product made of foam material will not accommodate every individual to the same degree.

Various thermally formed or heat activated footwear inserts such as U.S. Pat. No. 4,237,626 taught by Dennis N. Brown have been introduced in the United States, and in particular, skate and ski boot manufacturers have enjoyed some commercial success with products of this general type. However, the application of such footwear inserts generally involves the use of a relatively high temperature heating gun or toaster oven, and numerous procedures which must be administered by a retailer. While generally less expensive, faster, and easier to make than prescription orthotics, these methods and devices can expose wearers to high temperatures and require nearly thirty minutes to perform.

Permanently inflated "air bags," or "diffusion pumping devices" such as those taught by Marion F. Rudy, e.g., U.S. Pat. No. 4,183,156, U.S. Pat. No. 4,219,945, U.S. Pat. No. 4,271,606, U.S. Pat. No. 4,287,250, U.S. Pat. No. 4,340,626, U.S. Pat. No. 4,906,502, U.S. Pat. No. 4,936,029, U.S. Pat. No. 5,042,176, U.S. Pat. No. 5,083,361, U.S. Pat. No. 5,543,194, U.S. Pat. No. 5,686,167, U.S. Pat. No. 5,741,568, and U.S. Pat. No. 5,753,061, all of these patents hereby being incorporated by reference herein, have enjoyed considerable commercial success, and have enhanced the cushioning and shock-absorbing qualities of articles of footwear. Other patents relating to thermoplastic film for use in fluid filled bladders and/or the structure of fluid filled bladders that are believed to be assigned or licensed to Nike, Inc. include, e.g., U.S. Pat. No. 4,817,304, U.S. Pat. No. 5,406,719, U.S. Pat. No. 5,592,706, U.S. Pat. No. 5,626,657, U.S. Pat. No. 5,755,001, U.S. Pat. No. 5,802,739, U.S. Pat. No. 5,832,630, U.S. Pat. No 5,979,078, U.S. Pat. No. 5,993,585, U.S. Pat. No. 6,013,340, U.S. Pat. No. 6,020,055, U.S. Pat. No. 6,082,025, U.S. Pat. No. 6,119,371, U.S. Pat. No. 6,127,026, U.S. Pat. No. 6,258,421, U.S. Pat. No. 6,321,465 B1, WO 01/170060 A2, WO 01/170061 A2, WO 01/170062 A2, WO 01/170063 A2, WO 01/170064 A2, and WO 01/78539 A2. A Gas filled bladder for making a shock absorbing cushion is taught in U.S. Pat. No. 6,161,240 granted to Ing-Jing Huang. Gas filled bladders or other cushioning mediums granted to Martyn Shorten and/or Joseph Skaja include U.S. Pat. No. 5,572,804, U.S. Pat. No. 5,976,451, U.S. Pat. No. 6,029,962, and U.S. Pat. No. 6,098,313. Gas filled bladders or pads taught by Byron Donzis include U.S. Pat. No. 5,235,715, U.S. Pat. No. 4,874,640, U.S. Pat. No. 4,513,449, U.S. Pat. No. 4,486,901, U.S. Pat. No. 4,453,271, U.S. Pat. No. 4,441,211, U.S. Pat. No. 4,370,754, and U.S. Pat. No. 4,217,705. Teachings related to athletic equipment by J. C. Wingo include U.S. Pat. No. 5,036,761, U.S. Pat. No. 5,035,009, U.S. Pat. No. 5,029,341, U.S. Pat. No. 4,985,931, U.S. Pat. No. 4,926,503, and U.S. Pat. No. 4,872,216.

However, the use of relatively high inflation pressures in a permanently inflated "air bag," that is, a bladder having inner volume including gaseous matter, and the like, generally achieves superior cushioning and shock-absorption at the expense of conformance due to the difficulty of manufacturing "air bags" so as to accommodate complex anatomical shapes, whereas the use of relatively low inflation pressures in an "air bag" characterized by a relatively thin cross-section generally achieves conformance at the expense of cushioning and shock-absorption. Selectively inflatable air bladders, e.g., U.S. Pat. No. 4,874,640 taught by Byron A. Donzis, which can be inflated by manually actuating a pumping mechanism or other inflation means, can attain substantial conformance with respect to a portion of a wearer's anatomy. However, the relatively low inflation pressures generally associated with such air bladders can fail to provide optimal cushioning, or stability when such air bladders are subjected to the force applications commonly generated by wearers of athletic footwear during use. Accordingly, in an alternate embodiment of the present invention, a light cure material and a void including at least one gas can be included within the inner volume of a conformable device, thereby enabling an "air bag," that is, a bladder having inner volume including gaseous matter, to be formed to a desired shape when the light cure material is caused to set and cure.

As taught in U.S. Pat. No. 4,219,945 granted to Rudy, previously incorporated by reference herein, it can sometimes be advantageous to "tune" the mechanical response of a cushioning element in accordance with certain criteria, e.g., in order to influence the magnitude and rate of compression and recovery of the cushioning element when loaded by a wearer during use and thereby render the response of an article of footwear more in harmony with bodily movements: see column 2, lines 1–5, and column 7, lines 47–52. In addition, a biomechanically tuned shoe including a spring element is taught by Thomas McMahon in U.S. Pat. No. 4,342,158. The following United States utility patents granted to Hugh Herr and Rustem Gamow also teach articles of footwear including spring elements: U.S. Pat. No. 5,367,790, granted Nov. 29, 1994, entitled "Shoe and Foot Prosthesis with a Coupled Spring System;" U.S. Pat. No. 5,701,686, granted Dec. 30, 1997, entitled "Shoe and Foot Prosthesis with Bending Beam Spring Structures;" and, U.S. Pat. No. 6,029,374, granted Feb. 29, 2000, entitled "Shoe and Foot Prosthesis with Bending Beam Spring Structures." Moreover, the applicant also has also filed the following pending utility patent applications regarding an article of footwear including a cushioning system that can be customized by a wearer, as desired: U.S. patent application Ser. No. 09/523,341, filed Mar. 10, 2000, entitled "Article of Footwear Having a Spring Element and Selectively Removable Components;" PCT Patent Application No. PCT/US01/07484, filed Mar. 8, 2001, entitled "Article of Footwear Having a Spring Element and Selectively Removable Components;" U.S. patent application Ser. No. 09/573,121, filed May 17, 2000, entitled "Customized Article of Footwear and Method of Conducting Retail and Internet Business;" PCT Patent Application No. PCT/US01/16159, filed May 17, 2001, entitled "Customized Article of Footwear and Method of Conducting Retail and Internet Business;" and U.S. patent application Ser. No. 10/152,402, filed May 21, 2002, entitled "Customized Article of Footwear and Method of Conducting Retail and Internet Business." Accordingly, a further object of the present invention can be to assist in the task of providing a "tuned" mechanical response and/or enhanced cushioning and shock-absorbing effects.

There have also been a number of attempts to introduce conformable materials such as flowable or viscous liquids, or flowable solids into articles of footwear in order to accommodate an individual wearer, e.g., U.S. Pat. No. 3,237,319 taught by A. W. Hanson, U.S. Pat. No. 3,407,406 to F. D. Werner et. al., U.S. Pat. No. 4,038,762 to Jack C. Swan, Jr., U.S. Pat. No. 4,380,569 to Robert E. Shaw, U.S. Pat. No. 4,977,691 to Lewis P. Orchard, III, and also U.S. Pat. No. 5,592,706, U.S. Pat. No. 5,626,657, and U.S. Pat. No. 6,020,055, to Tony Pearce. These materials generally remain flowable liquids or solids, and when subjected to a force application become moldable in conformance with a portion of a wearer's anatomy. However, such materials and devices normally resume an unformed state upon removal of an article of footwear and are therefore without a "memory" capability. This ability can be viewed as potential benefit, or alternatively, as a liability depending upon the intended object. In addition, such conformable materials can possibly add undesirable weight to an article of footwear when used in substantial quantities.

Further, there have been attempts to introduce conformable materials substantially comprising flowable liquids or solids in articles of footwear which can be caused to form substantially non-flowable solid material when caused to set and cure, e.g., U.S. Pat. No. 2,092,910 taught by C. H. Daniels, U.S. Pat. No. 3,786,580 to Melvin W. Dalebout, U.S. Pat. Nos. 4,128,951, 4,272,898, and 4,385,024 to Horace A. Tansill, U.S. Pat. No. 5,002,047 to Timothy C. Sandvig et. al., and U.S. Pat. Nos. 5,042,100, and 5,095,570 to Aharon Bar et. al. Some of the prior art has proven deficient as result of the use of unsuitable designs or materials. Moreover, the procedures and methods associated with these attempts have for the most part been relatively complex, time consuming expensive, or otherwise not amenable to mass production and use by the general public. The applicant has been granted other patents relating to conformable devices or insoles, namely, U.S. Pat. No. 4,674,206, U.S. Pat. Nos. 5,101,580, 5,203,793, and 5,632,057, all of these patents hereby being incorporated by reference herein. In particular, the applicant's U.S. Pat. No. 5,632,057 teaches the use of ultraviolet and visible light to cause a light cure material contained in a conformable device, e.g., an insole, to set and cure, thus providing conformance and support to a portion of a wearer's anatomy. The use of corrective devices such as posts or wedges in conjunction with a conformable device for making custom orthotics is also taught in U.S. Pat. No. 5,632,057. Further, U.S. Pat. No. 4,512,340 to Carl Buck teaches the making of casts using light cure materials, and U.S. Pat. No. 3,905,376 to Amos Johnson et al. teaches "A Pedicure Prosthesis For The Metatarsal Arch Of The Foot," both of these patents hereby being incorporated by reference herein. U.S. Pat. No. 4,765,411 to Jerald Tennant teaches an "Ultraviolet-Cured Horse Shoe and Method of Shoeing Hoofed Animals."

Visible light cure materials consist of one or more monomers or oligomers comprising liquid, or viscous matter which are capable of polymerization and crosslinking to form solid matter when a suitable photoinitiator included therein is excited by light having a particular wavelength, thereby causing at least one chemical reaction, that sometime involves free radicals, which ultimately result in the desired polymerization and crosslinking chemical reaction. Light cure materials for use in the present invention can be made from polymers, copolymers, resins, epoxies, acrylics, plastics, elastomers, natural and synthetic rubbers, e.g., silicone, polyurethane, vinyl polyester, styrene, and the like. Light cure materials are used as optical coatings, and also as encapsulation or insulation means for use in the electronics industry. Further, blue light cure materials are known in the medical dental industry, e.g., FERMIT®, TETRIC®, and HELIOMOLAR RADIOPAQUE®, distributed by Ivoclar Vivadent of 175 Pineview Drive, Amherst, N.Y. 14218. It is also known to use light cure technology in the field of optics as disclosed in U.S. Pat. No. 5,597,519, U.S. Pat. No. 5,422,046, and U.S. Pat. No. 5,529,728.

The present invention also relates to the use of various devices, methods, and processes for effecting necessary and sufficient exposure of a conformable device, or any other footwear components including light cure materials, to visible light having a wavelength substantially between 400–780 nanometers in order to cause the light cure materials to set and cure, and thereby provide, whether in partial or complete combination: custom fit, stability, support, comfort, and enhanced cushioning effects. Accordingly, the present invention also teaches a point of purchase display that includes a light table. The point of purchase display can serve to display conformable devices such as insoles, and also other various footwear and apparel items. Moreover, the present invention also teaches including a suitable light source in the floor of a retail store for causing a conformable device to set and cure in functional relation to a wearer's foot and also an article of footwear.

SUMMARY OF THE INVENTION

The present invention teaches a conformable device including a light cure material that can be caused to set and cure when exposed to visible light having a wavelength substantially between 400–780 nanometers for customizing a portion of an article of footwear in order to enhance conformance or fit, support, comfort, and cushioning, in partial or complete combination. In particular, a custom conformable device consisting of an insole, or portion thereof, can serve to accommodate the unique anatomical features and characteristics of an individual wearer. When a wearer's foot is positioned in functional relation to a conformable device, a force application can be made thereupon causing a light cure material contained therein to be displaced and mold in conformance with the shape of the wearer's foot. The light cure material can then be caused to set and cure using a suitable visible light source thereby causing the shape imparted to the conformable device to be substantially retained, thus providing a permanent memory capability. Further, the present invention teaches a method of making a conformable device including the use of a light table that can be part a point of purchase display, or alternately, the floor of a retail store.

In a preferred embodiment, a conformable device for use in an article of footwear and conforming to and supporting a portion of a wearer's anatomy comprises a pliable casing forming a bladder including at least one chamber having inner volume. A light cure material is included therein and displaces at least a portion of the inner volume of the chamber. At least a portion of the pliable casing is capable of transmitting visible light having a wavelength between 400 and 780 nanometers which is capable of causing the light cure material to set and cure. When a portion of the wearer's anatomy is positioned in functional relation to the conformable device to cause a force application to be made thereupon and cause at least a portion of the conformable device to be formed in conformance with the portion of the wearer's anatomy, and the light cure material is exposed to visible light having a wavelength substantially between 400 and 780 nanometers to cause the light cure material to set and cure, the conformable device can substantially retain the shape imparted by the portion of the wearer's anatomy.

Further, in a preferred embodiment of a conformable device the light cure material is isolated from visible light by a selectively removable barrier material, whereby premature exposure of the light cure material is prevented.

Further, in a preferred embodiment of a conformable device the pliable casing is made from a substantially transparent plastic material.

Further, in an alternate preferred embodiment of a conformable device, a foam material is included within the chamber. In addition, the foam material can comprise a shape generally conforming to a portion of a wearer's anatomy. The select and coordinated use of a foam material in communication with a light cure material can provide select physical and mechanical properties to be exhibited as between at least two portions of the conformable device, as desired.

Further, in a preferred embodiment of a conformable device the light cure material comprises a resilient elastomeric material after being caused to set and cure.

Further, in a preferred embodiment of a conformable device for use as a insole or sockliner, the conformable device extends from an area about the heel to an area rearward of the metatarsal heads and underlies at least a portion of the wearer's medial longitudinal arch.

Further, in a preferred embodiment of a conformable device, the conformable device includes means for removable attachment in functional relation to an article of footwear. The means for removable attachment can comprise a self-adhesive surface that can be exposed by removal of a peel-ply layer.

Further, in an alternate preferred embodiment of a conformable device, the conformable device can further include a void including at least one gas. A gas can be at atmospheric pressure, or alternately, be pressurized above atmospheric pressure. In addition, a gas can include, at least in part, ambient air, a "supergas" as recited in the U.S. Patents granted to Rudy previously incorporated by reference herein, or a captive gas such as nitrogen, and the like. Furthermore, it can be readily understood that the inclusion of a light cure material within a conformable device comprising, at least in part, an air bag or bladder containing a gas can cause the conformable device to be formed to a desired shape when the light cure material is caused to set and cure.

Further, in an alternate preferred embodiment of a conformable device the light cure material includes a foaming or blowing agent and comprises a foam material after being caused to set and cure.

Further, in an alternate preferred embodiment of a conformable device, the conformable device comprises an open-celled foam material impregnated with a light cure material.

Further, in an alternate preferred embodiment of a conformable device, the conformable device comprises a textile material impregnated with a light cure material.

Further, in an alternate preferred embodiment of a conformable device, the conformable device can be used in conjunction with a corrective device such as a post or wedge for introducing a correction as prescribed by a skilled medical professional.

A preferred method for permitting the transmission of suitable visible light to a conformable device within an article of footwear includes the use of an opening, or alternately, the use of at least one transparent material.

The method for making a conformable device for use with an article of footwear can include the use of a light table. The light table can comprise a portion of a point of purchase display, or alternately, be built into the floor of a retail store.

The present invention teaches a method for making a conformable device for use with an article of footwear comprising the steps of:

a) placing a conformable device including a light cure material which is capable of being cured when exposed to visible light comprising a wavelength between 400–780 nanometers upon a platform of a light table which is capable of providing said light, the light table comprising a light source positioned in functional relation thereto which is capable of irradiating at least a substantial inferior portion of the conformable device when the conformable device is positioned upon the platform and a foot of a wearer is placed thereupon;

b) placing the wearer's foot upon the conformable device, thereby causing a force application to be made thereupon and causing at least a portion of the conformable device to be formed in conformance with at least a portion of the wearer's foot; and c) activating the light source to cause the cure of the light cure material, thereby causing the shape imparted to the conformable device to be substantially retained.

The method for making a conformable device for use with an article of footwear can comprise the further step of:

d) removing a barrier material with respect to visible light from about the conformable device prior to placing the conformable device upon the platform.

The method for making a conformable device for use with an article of footwear can comprise the further step of:

d) placing the wearer's foot in approximately a neutral position upon the conformable device prior to causing the light cure material to cure, and retaining the wearer's foot in a neutral position upon the conformable device while causing the light cure material to cure.

The method for making a conformable device for use with an article of footwear can comprise the further step of:

d) placing the wearer's foot in approximately a neutral position upon the conformable device prior to causing the light cure material to cure, and adding a correction device with respect to the wearer's anatomy to the conformable device for substantially maintaining a neutral position, and retaining the wearer's foot in a neutral position upon the conformable device while causing the light cure material to cure. The correction device can comprise a post or wedge.

The method for making a conformable device for use with an article of footwear can comprise the further step of:

d) affixing the conformable device in functional relation to an overlaying sockliner prior to placing the conformable device upon the platform of the light table.

The present invention teaches a method for making a conformable device for use with an article of footwear including the use of a last configuration support comprising the steps of:

a) placing a conformable device including a light cure material which is capable of being cured when exposed to visible light comprising a wavelength between 400–780 nanometers upon a last configuration support and positioning the last configuration support on the platform of a light table which is capable of providing visible light, the light table comprising a light source positioned in functional relation thereto which is capable of irradiating at least a substantial inferior portion of the conformable device when the conformable device is positioned on the last configuration support, and the last configuration support is positioned upon the platform, and a foot of a wearer is placed upon the conformable device;

b) placing the wearer's foot upon the conformable device, thereby causing a force application to be made thereupon and causing at least a portion of the conformable device to be formed in conformance with at least a portion of the wearer's foot and also at least a portion of the last configuration support; and c) activating the light source to cause the cure of the light cure material, thereby causing the shape imparted to the conformable device to be substantially retained.

The method for making a conformable device for use with an article of footwear including the use of a last configuration support can comprise the further step of:

d) removing a barrier material with respect to visible light from about the conformable device prior to placing the conformable device upon the last configuration support.

The method for making a conformable device for use with an article of footwear including the use of a last configuration support can comprise the further step of:

d) placing the wearer's foot in approximately a neutral position upon the conformable device prior to causing the light cure material to cure, and retaining the wearer's foot in a neutral position upon the conformable device while causing the light cure material to cure.

The method for making a conformable device for use with an article of footwear including the use of a last configuration support can comprise the further step of:

d) placing the wearer's foot in approximately a neutral position upon the conformable device prior to causing the light cure material to cure, and adding a correction device with respect to the wearer's anatomy to the conformable device for substantially maintaining a neutral position, and retaining the wearer's foot in a neutral position upon the conformable device while causing the light cure material to cure. The correction device can comprise a post or wedge.

The method for making a conformable device for use with an article of footwear including the use of a last configuration support can comprise the further step of:

d) affixing the conformable device in functional relation to an overlaying sockliner prior to placing the conformable device upon the last configuration support.

The method for making a conformable device for use with an article of footwear including the use of a last configuration support can include the use of a light table. The light table can comprise a portion of a point of purchase display, or alternately, the be built into the floor of a retail store.

The present invention teaches a method for making a conformable device for use with an article of footwear while the conformable device is positioned within the article of footwear comprising the steps of:

a) placing a conformable device comprising a light cure material which is capable of being cured when exposed to visible light comprising a wavelength between 400–780 nanometers within an article of footwear which is capable of transmitting visible light to a substantial portion of the conformable device;

b) placing the foot of a wearer in functional relation to the conformable device, thereby causing a force application to be made thereupon and causing at least a portion of the conformable device to be formed in conformance with at least a portion of the wearer's foot; and c) exposing the article of footwear including the conformable device to visible light to cause the cure of the light cure material, thereby causing the shape imparted to the conformable device to be substantially retained.

The method for making a conformable device for use with an article of footwear while the conformable device is positioned within the article of footwear can comprise the further step of:

d) removing a barrier material with respect to visible light from about the conformable device prior to placing the conformable device within the article of footwear.

The method for making a conformable device for use with an article of footwear while the conformable device is positioned within the article of footwear can comprise the further step of:

d) placing the wearer's foot in approximately a neutral position upon the conformable device prior to causing the light cure material to cure, and retaining the wearer's foot in a neutral position upon the conformable device while causing the light cure material to cure.

The method for making a conformable device for use with an article of footwear while the conformable device is positioned within the article of footwear can comprise the further step of:

d) placing the wearer's foot in approximately a neutral position upon the conformable device prior to causing the light cure material to cure, and adding a correction device with respect to the wearer's anatomy to the conformable device for substantially maintaining a neutral position, and retaining the wearer's foot in a neutral position upon the conformable device while causing the light cure material to cure. The correction device can comprise a post or wedge.

The method for making a conformable device for use with an article of footwear while the conformable device is positioned within the article of footwear can comprise the further step of:

d) affixing the conformable device in functional relation to an overlaying sockliner prior to placing the conformable device within the article of footwear.

The method for making a conformable device for use with an article of footwear while the conformable device is positioned within the article of footwear can include the use of a light table. The light table can comprise a portion of a point of purchase display, or alternately, the be built into the floor of a retail store.

The method and steps associated with the use of preferred embodiments of the present invention are few and simple to perform, thus render use by the general public both possible and practical. The above described features and advantages, along with various other advantages and features of novelty are pointed out with particularity in the claims of the present application which are attached hereto. However, for a better understanding of the invention, its advantages, and objects obtained by its use, reference should be made to the drawings which form a further part of the present application and to the accompanying descriptive material in which there is illustrated and described preferred embodiments of the present invention.

DETAILED DESCRIPTION OF THE PREFERRED EMBODIMENTS

The present invention teaches a conformable device including a light cure material that can be caused to set and cure when exposed to visible light having a wavelength substantially between 400–780 nanometers for customizing a portion of an article of footwear in order to enhance conformance or fit, support, comfort, and cushioning, in partial or complete combination. In particular, a custom conformable device consisting of an insole, or portion thereof, can serve to accommodate the unique anatomical features and characteristics of an individual wearer. When a wearer's foot is positioned in functional relation to a conformable device, a force application can be made thereupon causing a light cure material contained therein to be displaced and mold in conformance with the shape of the wearer's foot. The light cure material can then be caused to set and cure using a suitable visible light source thereby causing the shape imparted to the conformable device to be substantially retained, thus providing a permanent memory capability. Further, the present invention teaches a method of making a conformable device including the use of a light table that can be part a point of purchase display, or alternately, the floor of a retail store.

Figure 1:
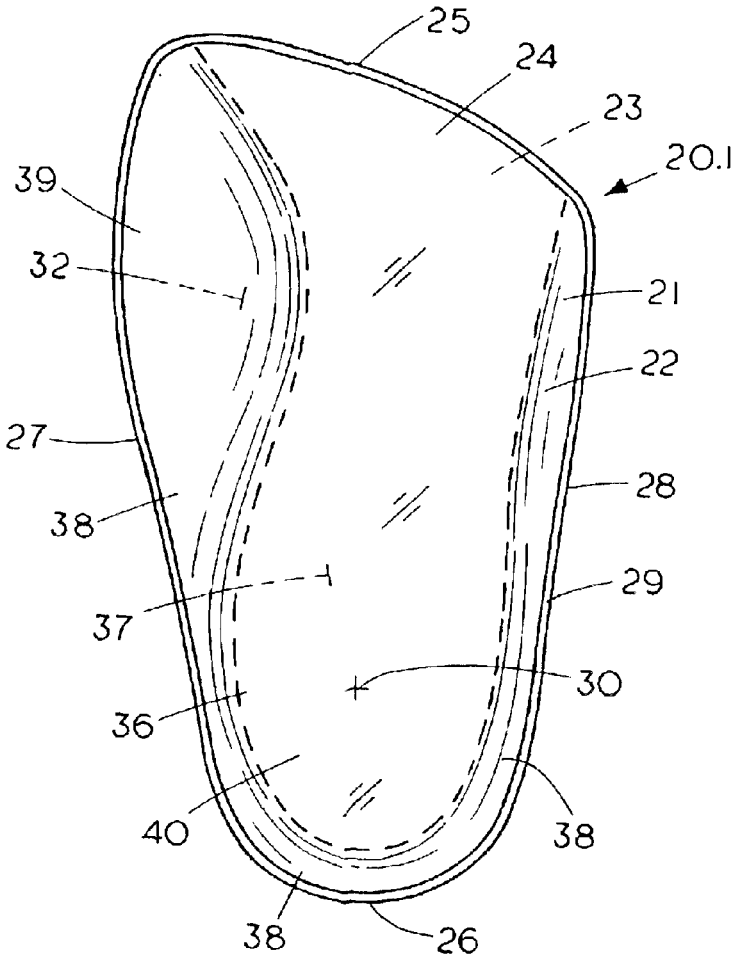
FIG. 1 is a top plan view of a conformable device for use with a wearer's right foot.

Referring the figures, wherein like reference numerals represent like parts throughout the several views, a conformable device 20.1 for making at least a portion of a custom insole for use with an article of footwear 53 is shown in FIG. 1.

FIG. 1 is a top plan view of a conformable device 20.1 for use with a wearer's right foot 31. The conformable device 20.1 can consist of a pliable casing 21 including two pieces of substantially transparent elastomeric thermoplastic film 22 having a thickness in the range between 8–20 mils on the generally opposing inferior side 23 and superior side 24. Other thicknesses can be suitable depending upon the materials being used, and the method and process of manufacture. It is normally advantageous that the pliable casing be relatively thin in cross-section, but also as clear or transparent as possible in order to enhance the transmission of light therethrough. In this regard, it has been found that the thickness of the material is not so much a limiting factor, as is the relative clarity or transparency of the material. It can be advantageous to select a tinted or colored transparent pliable casing for enhancing the transmission of a particular color of visible light having a wavelength approximately between 400–780 nanometers which is especially suitable for causing a selected visible light cure material to set and cure. The outer layer of the bladder faces generally opposite the inner layer of the bladder, the former being more distant and the latter being closest to the wearer's body. Preferably, at least the outer layer of the bladder is made of a substantially transparent film that permits the transmission of light therethrough. Suitable polyurethane films include MP 1880AE and MP 1890 AE having a thickness between 0.008–0.025 inches and having a Shore A hardness of 80–90, which are made by Deerfield Urethane, Inc. of Deerfield, Mass., but other materials can be suitable for use including those taught in the patents assigned to Nike, Inc. which have been recited within this specification.

The two pieces of film 22 can be affixed by radio frequency and/or heat and pressure welds 29 along any mating edges to form a bladder 36 including at least one chamber 32 having inner volume. As shown in FIG. 1, the pliable casing 21 can be vacuum formed in a desired generic shape so as to create a pre-formed cupped formation including elevated contours 38 about the central area of the heel 30, and also the medial side 27 and lateral side 28 of a wearer's foot 31. Alternately, the conformable device 20.1 can be blow-molded, injection blow-molded, or otherwise molded or formed using conventional methods and techniques to create a desired three dimensional shape.

The pliable casing 21 can form at least one chamber 32 having inner volume and comprises a durable material, thus enabling a conformable device 20.1 to withstand the loads anticipated during implementation of the present invention and normal use. If desired, a wearer can evaluate a conformable device 20.1 while the light cure material 37 is still in a liquid or viscous state prior to substantially exposing the conformable device 20.1 to a suitable light source that will cause the flowable light cure material 37 to become transformed into solid matter. In an alternate embodiment, a portion of a pliable casing can be affixed to a different material to form a bladder and chamber of a conformable device. For example, a conformable device could be formed in association with an overlying sockliner and use a portion of the sockliner for structural integrity and enclosure. Further, the overlying sockliner could be made at least in part of a foam material and the inferior portion thereof could be formed to a select generic shape generally conforming to a portion of a wearer's foot and be substantially contained within the inner volume of a conformable device so as to simultaneously serve the function of a pliable casing, and also a foam material of select generic shape.

A wearer's foot can "bottom out" and be substantially supported in upon conformable device 20.1 without substantial quantities of light cure material 37 being present under the heel or ball of the foot. The conformable device 20.1 can thereby serve to substantially fill the space between the foot and a supporting surface within the article of footwear 53. Accordingly, the conformable device 20.1 can provide support without adversely affecting the fit of a wearer's foot in relation to an article of footwear 53. The conformable device 20.1 can then be custom molded to support the area of a wearer's longitudinal arches, transverse arches, and both the medial side 27 and lateral side 28 of the foot 31.

Further, a conformable device 20.1 can enhance conformance and thereby increase the effective area within the interior of the upper and also the sole of an article of footwear that is being used to attenuate force applications. Therefore, it is generally possible for a wearer to enjoy reduced plantar pressures and superior cushioning effects with the use of a conformable device 20.1. As a result, the thickness of the sole of an article of footwear can sometimes be decreased without compromising a given level of cushioning quality. Lower heel elevations can be associated with improved footwear stability.

When used in a running shoe application, it can sometimes be advantageous that the chamber 32 of a conformable device 20.1 not extend forward of the area associated with the metatarsal-phalangeal joints of a wearer's foot 31. As shown in FIG. 1, the approximate center of the area corresponding to the ground engaging portion of a wearer's heel has been indicated with an X and numeral 30. Also shown are the anterior side 25, posterior side 26, superior side 24, inferior side 23, transparent material 40, light cure material 37, and an appendage 39.

As shown in FIG. 1, the appendage 39 can provide support to the medial side 27 of a wearer's foot. It can be readily understood that a plurality of appendages of desired shape and location could be used with alternate embodiments of a conformable device. For example, see drawing FIG. 7 and related discussion within this specification. Additional information concerning the possible use of an appendage can be found in the applicant's U.S. Pat. No. 5,632,057, previously incorporated by reference herein.

Alternate embodiments of a conformable device can include a plurality of chambers which are in continuous fluid communication, or a plurality of individual chambers. In addition, different individual chambers within a conformable device can contain different light cure materials and/or other material components and can thereby exhibit different physical and mechanical properties. It can be readily understood that different chambers having different form and/or inner volume containing like material components can also exhibit different physical and mechanical properties. Moreover, an article of footwear can employ a plurality of conformable devices.

In an alternate embodiment, a portion of a pliable casing on the inferior side of a conformable device can be made of a substantially transparent elastomeric polyurethane film having a thickness in the range between 8–20 mils that is affixed by radio frequency and/or heat and pressure welds to the bottom of the superior side of the pliable casing. However, the superior side of the pliable casing can be made of a different material, e.g., a substantially closed cell or microcellular foam material that includes elevated contours so as to create an arch support and cupped shape about the medial side, posterior side, and lateral side of a wearer's heel and foot. The superior side of the foam material used to make the superior side of the pliable casing can further include a synthetic textile material. It can be readily understood that an alternate conformable device an be made in ¾ or full length, and that the superior side of the pliable casing can then constitute an overlaying sockliner.

Suitable man-made or artificial light sources for curing a conformable device 20.1, and the like, include, but are not limited to fluorescent light bulbs or lamps. When a natural light photoinitiator that is especially sensitive to the blue portion of the light spectrum such as H-NU 470 made by Spectra Group Limited of Maumee, Ohio, or alternately, IRGACURE® 784 made by Ciba Specialty Chemicals of Tarrytown, N.Y. is used to trigger the light cure reaction, fluorescent lamps having substantial power in the blue portion of the visible light spectrum can be advantageous for use, such as "Daylight/6500K," "Colortone 50/5000K," "Colortone 75/7500K," "Actinic" or "SuperActinic," and in particular, "Special Blue" light bulbs or lamps made by the Phillips Lighting Company of Somerset, N.J. The preferred fluorescent lamp for use that has exceptional brightness and sufficient spectral power in the blue portion of the light spectrum is General Electric's BIAX® F40/30BX/SPX50. One manufacturer of visible light photoinitiators, and in particular, of a blue light photoinitiator known as H-NU 470, is Spectra Group Limited of Maumee, Ohio. Another manufacturer of visible light photoinitiators is Ciba Specialty Chemicals of Tarrytown, N.Y. Ciba ultraviolet light photoinitiators include IRGACURE® 369, and 819. However, the preferred Ciba visible light photoinitiators include IRGACURE® 184, and in particular, IRGACURE® 784.

Coloring agents can be used to identify a particular light cure material and the associated physical and mechanical properties of a conformable device. Coloring agents can also be used to indicate the completion of the light cure chemical reaction. For example, the aforementioned H-NU 470 and IRGACURE® 784 blue light photoinitiators are orange in color, but bleach to a pale orange or clear when exposed to a suitable blue light source. This change takes place as the photoinitiator is excited by the blue light source and consumed in the ensuing chemical reaction. Accordingly, the photoinitiator gives the same color change to any relatively colorless light cure material in which it is being used. Other color changes are possible to effect as desired. For example, it is possible to include a further coloring agent, that is, a green coloring agent to mask the orange photoinitiator with the result that the light cure material will change from a green color to a blue color when the corresponding blue light cure is completed. This can facilitate successful implementation of the present invention. Obviously, the use of photoinitiators corresponding to different portions of the visible light spectrum can result in different colors being given, as desired, to a light cure material.

Suitable light cure materials generally comprise flowable or viscous liquids, and flowable or otherwise conformable solids that can be caused to become substantially less flowable or conformable, or completely non-flowable or conformable solid matter after being caused to set and cure. For the purpose of more clearly defining the relative magnitude of this transformation with reference to a footwear insole or orthotic application: 1) a doubling of the viscosity of a liquid or viscous light cure material; or alternately; 2) a 25 percent increase in the hardness of a light cure material on a Shore scale; or alternately, 3) a 25 percent increase in the stiffness of a light cure material in bending or compression, or alternately, and as generally preferred, 4) a change in the phase state of a light cure material that initially is substantially in a liquid or viscous state, but which substantially consists of solid matter after being caused to set and cure upon exposure to visible light having a wavelength between 400–780 nanometers, shall be considered within the scope of the present invention.

Generally, light cure materials consist of one or more monomers or oligomers comprising liquid, or viscous matter which are capable of polymerization and crosslinking to form solid matter when a suitable photoinitiator included therein is excited by light having a particular wavelength, thereby causing at least one chemical reaction, that may involve free radicals, which ultimately result in the desired polymerization and crosslinking chemical reaction. Light cure materials for use in the present invention can be made from polymers, copolymers, resins, epoxies, acrylics, plastics, elastomers, natural and synthetic rubbers, e.g., silicone, polyurethane, vinyl, polyester, styrene, and the like.

Light cure materials having a wide range of physical and mechanical characteristics are made, e.g., by Dow Corning Corporation of Midland, Mich., UVEX, Inc. of Sunnyvale, Calif., Sartomer, Inc. of Exton, Pa., 3M Minnesota Mining Company of St. Paul, Minn., Loctite Corporation of Rocky Hill, Conn., and Borden, Inc. of Columbus, Ohio. Another major manufacturer of light cure materials known by the EBERCRYL® trademark is UCB Radcure of Smyrna, Ga. A light cure material identified as Q3-6696 made by Dow Corning Corporation, or another identified as 3584 made by Loctite Corporation, and the like, can be suitable for use as a relatively soft, flexible, and shock absorbing material, whereas a light cure material identified as 3102 or 3106 made by Loctite Corporation can be suitable for use as relatively rigid and non-flexible light cure material. Further, an ultraviolet and/or natural light cure polyester resin, and also a light cure material epoxy known by the trade name SOLAREZ are made by Wahoo International, in Oceanside, Calif., and these can be used to make a relatively rigid light cure material. When used alone, the SOLAREZ polyester resin is relatively brittle when flexed, but when it is used to impregnate a textile material such as fiberglass, the resulting product is robust. When it is desired to make a conformable device that is substantially rigid yet light-weight, a woven or non-woven fiberglass textile material can be included with a conformable device. However, the preferred light cure materials for use in making a conformable device are made by San Rafael Coating of 700 Hawthorne Street, #A, Glendale, Calif. In particular, a light cure material made of an acrylated urethane and monomer blend known as SRC A-3, and another light cure material that is less flexible and made of an acrylic oligomer and monomer blend epoxy known as SRC A-8 have been developed for use in the present invention.

More detailed information relating to light cure materials can be found in U.S. Pat. No. 4,451,634 assigned to General Electric Company, U.S. Pat. No. 4,892,895 and U.S. Pat. No. 4,943,613 assigned to Shin-Etsu Chemical Company, Ltd., U.S. Pat. No. 4,935,455 assigned to Toshiba Silicone Company, Ltd., and U.S. Pat. No. 4,780,486, U.S. Pat. No. 4,923,754, U.S. Pat. No. 4,831,064, U.S. Pat. No. 4,946,874, U.S. Pat. No. 5,057,550, U.S. Pat. No. 5,077,083, U.S. Pat. No. 5,082,873, U.S. Pat. No. 5,084,489, U.S. Pat. No. 5,089,537, U.S. Pat. No. 5,124,212, and U.S. Pat. No. 5,208,312, assigned to Dow Corning Corporation of Midland, Mich. Other light cure materials are made by UVEXS, Inc. of Sunnyvale, Calif., e.g., as taught in U.S. Pat. No. 4,973,611, and the UVEXS "500" and "600" series of polyurethane based light cure materials. Again, light cure materials are made by Sartomer, Inc. of Exton, Pa. Light cure materials are also made by Loctite Corporation of Rocky Hill, Conn., and these include "3584" which is a polyurethane based material, LITE-TAK® products, IMPRUV®, and a coating for optical fibers taught in U.S. Pat. No. 5,558,937. Light cure materials are made by Henkel Adhesive Group of Elgin, Ill., such as PHOTOMER® products. Light Cure materials are made by Borden, Inc. of Columbus, Ohio, e.g., U.S. Pat. No. 5,352,712, U.S. Pat. No. 5,527,835, U.S. Pat. No. 5,538,791, U.S. Pat. No. 5,587,403, and U.S. Pat. No. 5,639,846 which are largely directed to coating for optical fibers. 3M Minnesota Mining and Manufacturing Company makes light cure materials as taught in U.S. Pat. No. 5,545,676, U.S. Pat. No. 5,583,178, and U.S. Pat. No. 5,635,545. Morton Thiokol, Inc. of Chicago, Ill. makes light cure materials as taught in U.S. Pat. No. 4,377,679, U.S. Pat. No. 4,786,586, and U.S. Pat. No. 4,789,625. Examples of other recently patented light cure materials are recited in U.S. Pat. No. 5,177,120 assigned to Dentply Research & Development Corporation of Germany, U.S. Pat. No. 5,183,599 to Jack H. Smuckler, U.S. Pat. No. 5,187,040 assigned to Hoechst Aktiengesellschaft of Germany, U.S. Pat. No. 5,180,756 assigned to BASF Aktiengesellschaft of Germany, U.S. Pat. No. 5,183,831 assigned to Ciba-Geigy Corporation of Michigan, U.S. Pat. No. 5,262,200 granted to Puder et al., U.S. Pat. No. 5,593,736 granted to Cowen et al., U.S. Pat. No. 5,492,987 granted to Minns, and U.S. Pat. No. 5,185,385 assigned to Texico Chemical Company of California. The above information demonstrates the wide range of materials that are available and some of the numerous manufacturers presently associated with light cure technology.

Generally, a light cure material must be substantially exposed to a suitable light source in order to be completely caused to set and cure, that is, if one portion of a light cure material is exposed to a suitable light source it can be made to set and cure, whereas an adjoining portion shielded from a suitable light source will remain uncured. It is anticipated that light cure materials can be produced that will be capable of setting and curing in their entirety even when only a portion is exposed to a suitable light source. Light cure materials presently exist that are known to have a "shadow cure" capability, that is, an alternative cure capability such as thermal cure, or moisture cure.

The working and setting or cure time of the light cure material can be selected and engineered according to certain criteria. The working time of a light cure material can be regulated as desired by selections made regarding the types, amounts and concentrations of the photoinitiator and accelerators being used with a selected light cure material, and also selections made regarding the quality and intensity of the light source.

Generally, with reference to the making of a conformable device such as an insole or orthotic, it is advantageous for the light cure material to have a working time in the range between thirty seconds and three minutes, and in particular, in the range between one and two minutes. However, a longer or shorter working and cure time can be suitable depending upon the light cure material being used and the particular application. Normally, the faster the set and cure time, the more exothermic will be the associated chemical reaction. Even though a wearer is normally prevented from making direct contact with a conformable device during the curing process because of the presence of an overlaying sockliner, it can be advantageous that the selected light cure material not yield an exothermic chemical reaction in excess of 120 degrees Fahrenheit.

It is normally advantageous to cause the light cure material associated with a conformable device to be caused to cure while the conformable device is positioned in functional relation to a portion of a wearer's anatomy. However, an alternate method is to utilize a highly viscous light cure material that will substantially retain the shape imparted thereto by a wearer for a period of time necessary and sufficient to effect the cure of a light cure material after the wearer's foot is removed.

The hardness of the light cure material to be used in a conformable device can be selected according to various performance criteria. Generally, the preferred light cure material for use in a conformable device or orthotic application has a hardness in the range between 10–90 Shore A, and in particular in the range of 35–75 Shore A, although other Shore scales of hardness are commonly used in the footwear industry, and other measures can be more appropriate for use depending upon the nature of the light cure material selected for use in a particular embodiment of the present invention. A light cure material having a hardness corresponding to 35–75 Shore A can at least partially attenuate force applications and dampen shock while providing conformance to a portion of a wearer's foot in functional relation to an article of footwear. Nevertheless, it can be readily understood that the physical and mechanical properties of a light cure material, e.g., hardness, stiffness in bending and compression, to be used in various alternate embodiments of a conformable device can be selectively determined.

For example, when treating patients having diabetes, a relatively soft light cure material having a hardness in the range between 10–45 Shore A could be advantageous for use. As shown in FIG. 1, a conformable device 20.1 that is used to customize an insole or sockliner for an average wearer could use a light cure material 37 that would cure to a hardness in the range between 45–75 Shore A. Obviously, harder light cure materials in the range of 75–90 Shore A or D, could be suitable for producing custom heel counters, or relatively rigid supports for use in skates or ski boots. Accordingly, the physical and mechanical properties of a light cure material can be selected giving consideration to the wearer's body weight, anatomical and biomechanical characteristics, and the particular application and use for which the conformable device is intended. In some cases, included amongst the desired physical and mechanical properties of a conformable device, are those relevant to the attenuation of force applications and shock.

Again, as taught in U.S. Pat. No. 4,219,945 to Rudy, previously incorporated by reference herein, it can be advantageous to "tune" the mechanical response of a cushioning element associated with an article of footwear in order to influence the magnitude and rate of compression and recovery when it is loaded by a wearer during use so as to render the response of the article of footwear more in harmony with bodily movements: see U.S. Pat. No. 4,219,945; column 2, lines 1–5, and column 7, lines 47–52. In addition, Thomas McMahon teaches a biomechanically tuned shoe in U.S. Pat. No. 4,342,158, this patent having been previously incorporated by reference herein. Differences in a runner's weight, running speed, and style can influence desired values pertaining to the magnitude and rate of compression and recovery of a cushioning element. Generally, the rearfoot impact associated with running corresponds to a 20 Herz event, and the forefoot impact to a 5 Herz event. Generally, it can be advantageous to attenuate the rearfoot impact so that it more closely corresponds to a 5 Herz event.

Wearers having different size feet and arch characteristics can require different volumes of light cure material within a conformable device in order to attain a desired fit. Accordingly, the quantity of light cure material present within a conformable device intended for a particular use can be regulated during production so as to accommodate for the volumes associated with different foot sizes, and also different anatomical features and characteristics such as high, normal and low arches or so-called flat feet. Further, it can be readily understood that other solid, liquid, or gaseous matter, whether in partial or complete combination, can be selectively included within a conformable device during production.

For example, an individual having a men's size 11 foot and a high arch could require approximately 40–50 cc's of total volume to be filled under and about their foot in order to achieve good conformance and support when a conformable device is made for an article of footwear that provides a substantially flat interior support surface. However, when the same individual forms a conformable device for use in an article of footwear having a contoured interior support surface, then a volume of less than 20 cc's could provide good conformance and support.

The preferred embodiment of a conformable device 20.1, and the like, contains little or no gas within the chamber of the bladder. Some small amount ambient air can become trapped within the chamber upon filling and sealing of the conformable device, but this is incidental. However, in an alternate embodiment, a conformable device can further include within the inner volume of the bladder and chamber a void filled with fluid matter such as a liquid or gas. Generally, a captive gas contained within a conformable device will assume a superior position within the inner volume of the chamber in the area corresponding to the medial longitudinal arch adjacent to the wearer's foot. The inclusion of at least one entrapped gas can serve to reduce the weight by volume of a conformable device, aid in attenuating force applications and shock, or otherwise positively affect the physical and mechanical properties of a conformable device. Accordingly, the quantity of light cure material and any gas introduced within a conformable device can be anticipated or regulated during production.

The present invention can then be used in a synergistic manner with other footwear inventions, and in particular, the inventions of Rudy, previously recited and incorporated by reference herein, and/or those gas-filled bladders taught in the previously recited patents assigned to Nike, Inc., to yield a hybrid conformable device. In particular, substantial impermeability of a pliable casing to relatively large, inert, non-polar gaseous molecules or "supergases," but relative permeability to relatively small, polar, gaseous molecules can enable the operation of a "diffusion pumping" device. The applicant has effected the cure of suitable light cure materials both in external and internal relation to various inflated air bags constructed in accordance with the teachings of Rudy, and no special difficulty has been encountered. It can be readily understood that the use of a light cure material within a conformable device including a void containing at least one gas can enable conformable device to be formed to a desired shape. As can be appreciated, the task of permanently forming an air bag or gas-filled bladder to a desired shape in conformance with a portion of an individual's anatomy, is something not easily accomplished by conventional means.

The preferred embodiment of a conformable device contains little or no filler material. However, a light cure material can include at least one filler material to further reduce the density and weight by volume of the light cure material or to otherwise influence the physical or mechanical properties of the light cure material and conformable device in a desired manner. For example, the inclusion of fillers within some light cure materials can perform useful work regarding the attenuation of force applications and shock. It can be advantageous to utilize relatively transparent fillers that are capable of transmitting light so as to not adversely affect curing of the light cure material.

More specifically, organic or inorganic microspheres can be suitable filler materials, although other filler materials are also useable. However, unless the light gathering and reflecting properties, and also the clarity of the microspheres approximately matches that of the light cure material that is being used, and/or the filler material is substantially transparent, then the inclusion of substantial amounts of filler material can interfere with the curing process and increase the required cure time. In general, it is advantageous to not add a quantity of filler material as to exceed approximately 30% by volume of the resulting mixture of light cure material and filler.

Organic microspheres by KemaNord Company, Sweden, with product designation EXPANCEL® having a density in the range of 0.04 gram/cm3 can constitute a suitable and substantially inert lightweight filler. Organic microspheres have elastic properties in addition to their low density. Commercially available organic microspheres are commonly composed of PVDC/AN (polyvinylidene chloride/acrylonitrile) copolymer, carbon, phenolic materials, and the like. Inorganic microspheres having select densities can also be used as a filler in various applications of the present invention and these include, e.g., SCOTCHLIGHT GLASS BUBBLES®, manufactured by the 3M Company, and Z-LIGHT SPHERES®, manufactured by Zeelan Industries, Inc., both of St. Paul, Minn., and inorganic microspheres manufactured by the PQ Corporation, of Philadelphia, Pa., Commercially available inorganic microspheres are commonly composed of soda lime borosilicate, sodium borosilicate, silica, aluminosilicate, fly ash, perlite, ceramics, and the like. In contrast with organic microspheres, inorganic microspheres do not possess substantial elastic properties and they thus tend to more readily increase the overall hardness of an encapsulating light cure material. For this reason, it is necessary to use a softer durometer light cure material in conjunction with inorganic microspheres when a specific range of overall resultant hardness is desired.

The preferred embodiment of a conformable device contains no foaming or blowing agents. However, the use of foaming or blowing agents with a light cure material can constitute another method to accommodate for varying anatomical features and characteristics, as different volumes can be displaced by a given quantity of a foamed or blown light cure material. The foamed or blown light cure material can comprise a resilient and elastomeric material, or alternately, a relatively rigid material after a working or cure time, as desired. Foaming or blowing agents can also serve to reduce the weight of a conformable device. It should be noted that water can serve as a foaming or blowing agent for some polyurethane based materials. Additional information concerning foaming and blowing agents can be found in the applicant's U.S. Pat. No. 5,632,057, previously incorporated by reference herein.

Figure 15:
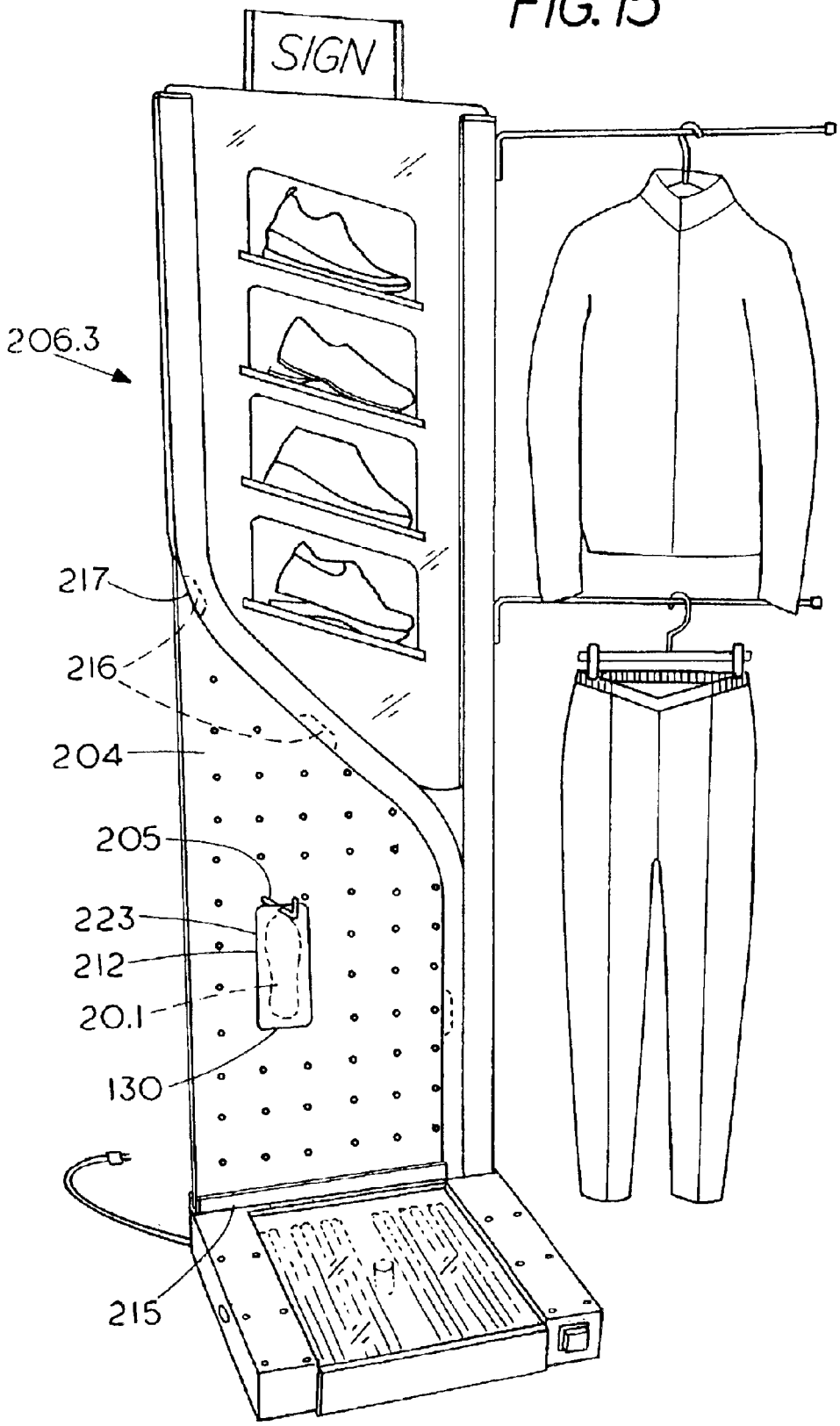
FIG. 15 is a perspective view of another alternate point of purchase display having a base including a light table, but also a pegboard.

A conformable device 20.1, and the like, can be sealed in a metal or plastic container such as ajar, envelope, package, or otherwise be selectively isolated by conventional means from visible and ultraviolet light while in storage using a suitable barrier material. Conventional means for isolating products from visible light using a barrier material which are known in the packaging industry include the use of barrier plastic films including metallic foils such as aluminum, and generally, those devices and means used in the protection of perishable foods, medicine, photographic film, and the like. Various barrier materials, devices, and methods can be used alone, or in partial or complete combination. As shown in FIG. 15, a conformable device 20.1, and the like, can be sealed in a container 212 possibly consisting of a plastic bag 223 consisting of a plastic film including a barrier material 130 such as aluminum with respect to visible light for protection and storage. When desired, the plastic bag 212 can be opened and the conformable device 20.1 removed for use by a wearer.

Figure 2:
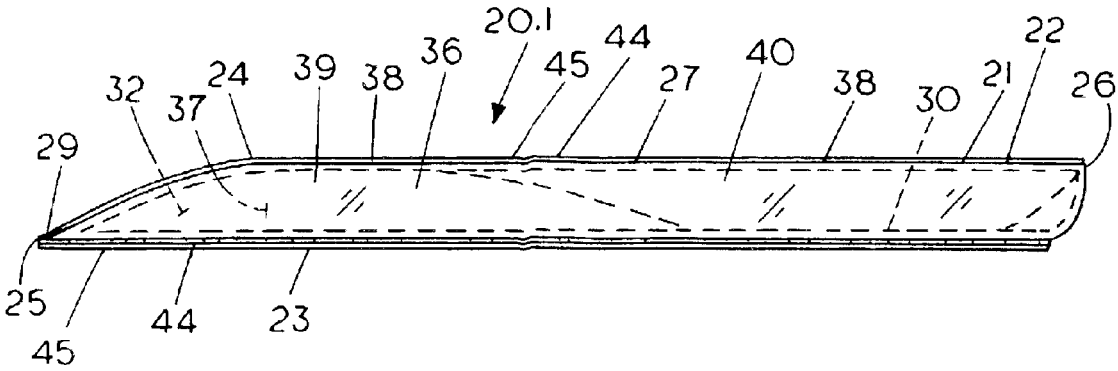
FIG. 2 is a medial side view of the conformable device shown in FIG. 1.

FIG. 2 is a side view of the medial side 27 of the conformable device 20.1 shown in FIG. 1. As shown, both the superior side 24 and inferior side 23 of the conformable device 20.1 can further include self-adhesive means such as a self-adhesive surface 44 which can be exposed by removing a peel-ply layer 45 for affixing the conformable device 20.1 to an overlaying sockliner 34, and also to the footbed of an article of footwear. The preferred adhesive being used at the present time is a "pressure sensitive" product that permits removal and replacement of conformable device 20.1 if ever necessary. SCOTCH-MOUNT® double coated foam adhesive tapes manufactured by the 3M Company, St. Paul, Minn., are being used at the present time, and in particular, 3M tape No. 4484, a white polyethylene foam tape with a thickness approximately of 1/16th or 0.063 inches, although other materials can be suitable for use. It is advantageous that self-adhesive materials have a temperature resistance meeting or exceeding approximately 120 degrees Fahrenheit, demonstrate resistance to solvents, in particular water, and have high adhesive qualities. A foam tape having a thickness of approximately 0.031–0.063 is preferred for use on the inferior portion of a conformable device 20.1 in most footwear applications in order to accommodate for irregularities between the surfaces to be joined. In some cases, a relatively thin double-coated adhesive tape can be used to affix a conformable device, and in particular, on the superior side of a conformable device when it is being affixed to an overlying insole. The 3M Company manufactures various adhesive tapes having specific bonding characteristics for affixing the particular target material surfaces.

Again, the pliable casing 21 can be vacuum formed in a desired generic shape to create a pre-formed cupped formation including elevated contours 38 about the central area of the heel 30, but also about the medial side 27 and lateral side 28 of a wearer's foot 31. Accordingly, the conformable device 20.1 can be custom molded to support the area of a wearer's longitudinal arches, transverse arches, and both the medial side 27 and lateral side 28 of the wearer's foot 31.

Figure 3:
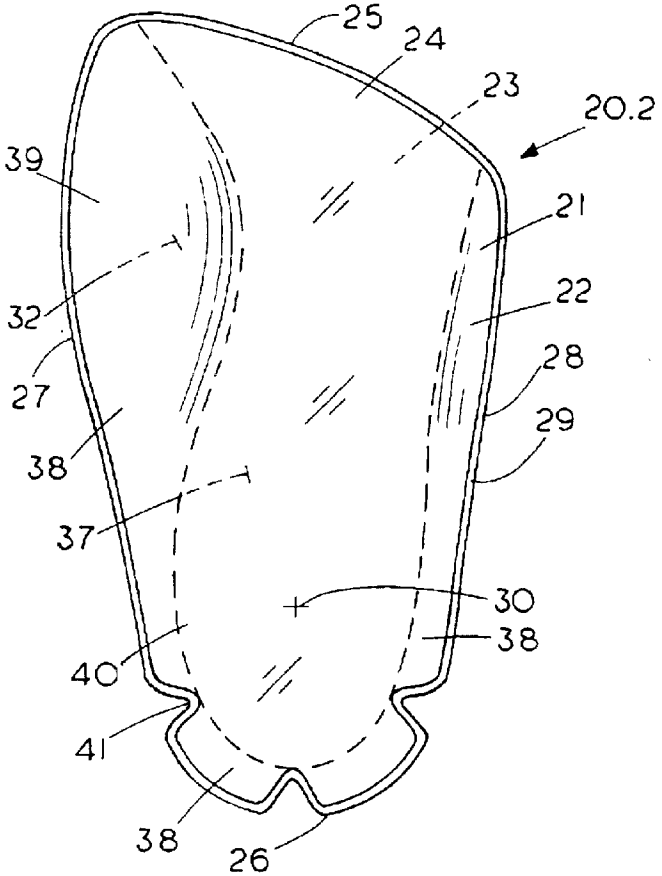
FIG. 3 is a top plan view of an alternate conformable device including a plurality of notches near the posterior side.

FIG. 3 is a top plan view of a conformable device 20.2 generally similar to that shown in FIG. 1, but including a plurality of notches 41 about the posterior side 26. When a conformable device 20.2 is simply made of two flat pieces of thermoplastic film 22 that are not subsequently vacuum formed to form a desired three dimensional shape, the inclusion of a plurality of notches 41 can permit the conformable device 20.2 to assume a desired three dimensional cupped shape about the heel of a wearer without bunching up.

Figure 4:
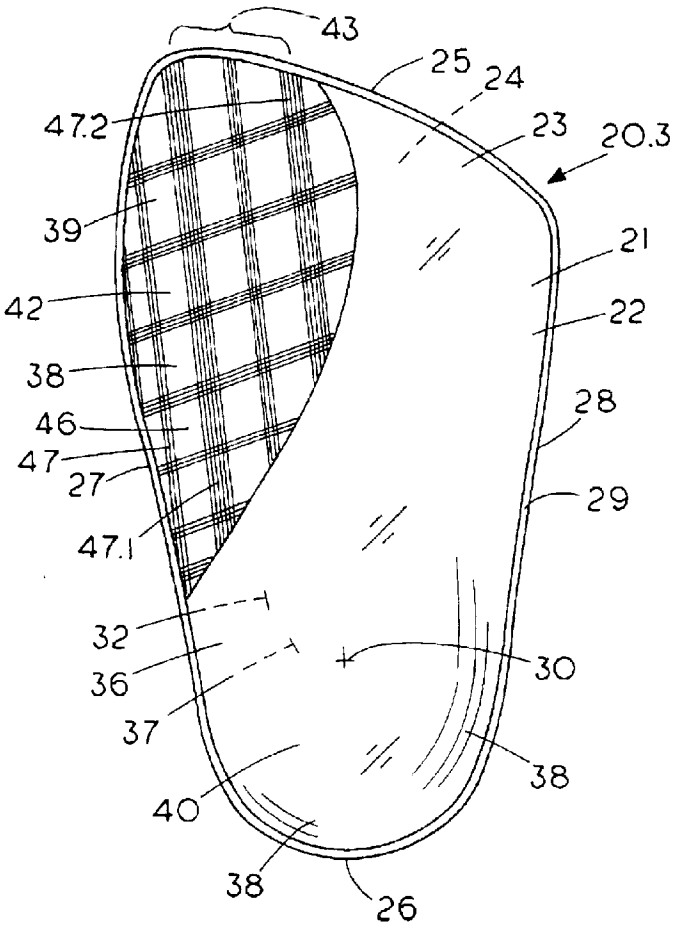
FIG. 4 is a bottom plan view of a conformable device for a wearer's left foot including a foam material.

FIG. 4 is a bottom plan view of a conformable device 20.3 generally similar to that shown in FIG. 1, but further including a foam material 42 contained in the chamber 32 formed within bladder 36. When the light cure material 37 is caused to cure, the foam material 42 can be at least partially "entrapped" and encapsulated by the light cure material 37, thus causing the impression or shape molded in approximate conformance with a portion of a wearer's anatomy to be retained.

The top side of the foam material 42 can be affixed in position to the bottom side of the piece of film 22 that is used to form the superior side 24 of the bladder 36 by conventional means such as adhesives or welding. In this regard, it can be advantageous to affix a selected foam material 42 to a portion of the pliable casing 21 generally opposite the anticipated direction of the penetrating light, or light source so that the light cure material will not be able to pass behind the foam material, and thereby, possibly be shielded from the light source.

The foam material 42 can be configured to support the area of the medial longitudinal arch and also a portion of the transverse arch of a wearer's foot 31. The foam material 42 can include a plurality of peaks 46 and valleys 47 that permit the light cure material 37 to substantially interpenetrate and encapsulate the foam material 42. As shown in FIG. 4, valleys 47.1 and 47.2 delimit an area corresponding to the approximate location of a substantial portion of the plantar fascia of a wearer's foot 31 when properly positioned upon conformable device 20.3. The plantar fascia originates slightly anterior of the position corresponding to the weight bearing center of the heel 30 and extends longitudinally along a path consistent with the area generally delimited between valleys 47.1 and 47.2. It can sometimes be advantageous that the physical and mechanical properties provided by the synergistic combination of the light cure material 37 and foam material 42 placed in this location permit deflection and protrusion of the plantar fascia during use.

Inclusion of a foam material 42 can reduce the weight of a conformable device 20.3, and can at least partially determine its physical and mechanical properties. In addition, a foam material 42 can be formed to a desired shape, e.g., generally conforming to a portion of a potential wearer's anatomy, and can thereby provide form and structure with regards to a conformable device 20.3. It can be readily understood that the coordinated use of a select foam material 42 with a select light cure material 37 can produce a synergistic result and enable select physical and mechanical properties to be exhibited by various portions of a conformable device 20.3, and the like. For example, in one select cross-sectional area a foam material 42 exhibiting greater stiffness in compression might be used in greater proportion relative to a light cure material 37 which forms a material exhibiting less stiffness in compression when cured, whereas in another select area the proportions could be reversed. Further, the stiffness and other mechanical characteristics of the foam material 42 and light cure material 37 could be just the opposite of that just described. Obviously, the configuration of a conformable device can also affect the mechanical properties exhibited in one or more portions. Accordingly, this provides a viable solution with respect to the need or desire to selectively vary the physical and mechanical properties afforded by various portions of a conformable device 20.3, and the like.

The foam material 42 can be made from a thermoset or thermoplastic material forming an open or closed cell structure. Accordingly, the foam material 42 can be made of natural or synthetic rubbers such as latex, or neoprene. However the preferred foam material 42 is made of a closed cell or micro-cellular polyurethane, or ethylene vinyl acetate (EVA) foam material, and the like. A foam material 42 can be surfaced with a self-skin, embossed, or treated with a primer or adhesive material. The preferred foam material 42 is made in a complex shape including peaks 46 and valleys 47, and can possibly be made in accordance with U.S. Pat. No. 5,118,722, hereby incorporated by reference herein, assigned to Illbruck, Inc. of Germany, and available in Minneapolis, Minn.

Further, a different form of matter can be used in communication with a desired foam material within a conformable device. For example, a silicone gel such as Dow Corning SYLGARD® 527, and the like, can be used in communication with a foam material to provide desired physical and mechanical properties in at least one portion of a conformable device. However, it is advisable to check the chemical compatibility of all materials being used in order to safeguard against any possible inhibition of the selected light cure material.

In general, the use of a light cure material, pliable casing and foam material that are made of the same family of material can facilitate effective bonding of the various components. It can therefore be advantageous to use polyurethane materials, as these are well known to have good bonding characteristics.

Figure 5:
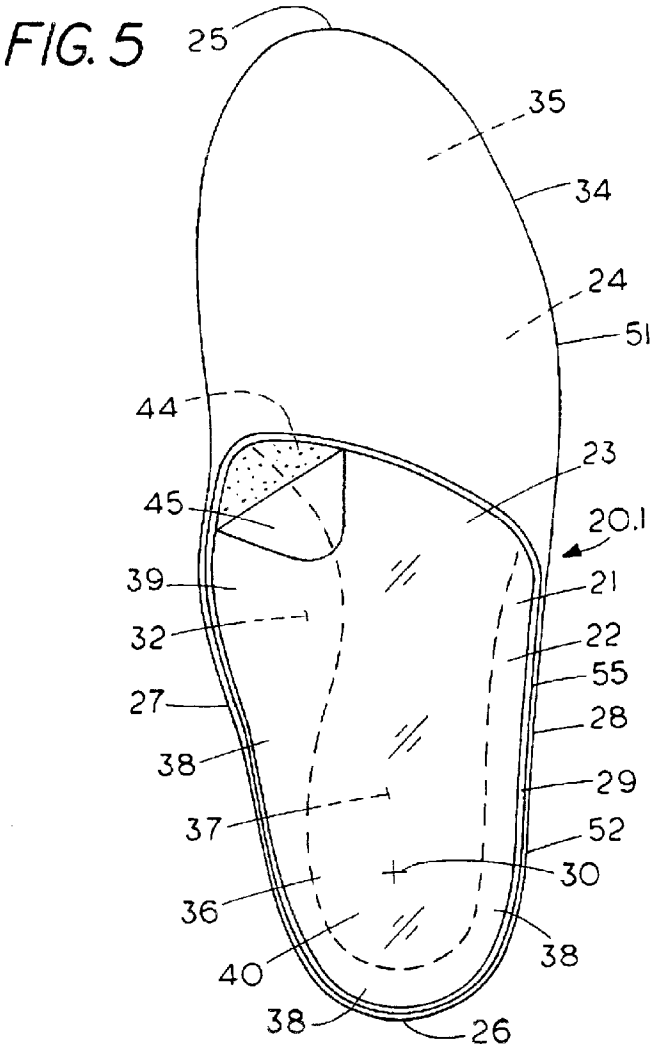
FIG. 5 is a bottom plan view of a three quarter length conformable device including light cure material affixed to an overlaying sockliner.

FIG. 5 is a bottom plan view of a conformable device 20.1, as shown in FIGS. 1 and 2. As shown, a conformable device 20.1 can be affixed in functional relation to an overlaying sockliner 34 using self-adhesive means, or other conventional means known in the art such as welding, and the like. When used in a running shoe application, it can be advantageous that the chamber 32 of conformable device 20.1 not extend forward of the area associated with a wearer's metatarsal heads. The sockliner 34 portion can include a textile material 35 on its superior side, and be made in full length as shown, or alternately in ¾ length. The preferred sockliner 34 is made of foam neoprene rubber, or alternately a polyurethane based PORON® material made by the 3M company, and further includes a textile material 35 on its superior side. It can be advantageous for enhancing both comfort and fit that the sockliner 34 portion slightly overlap the edges of the conformable device 20.1.

Figure 6:
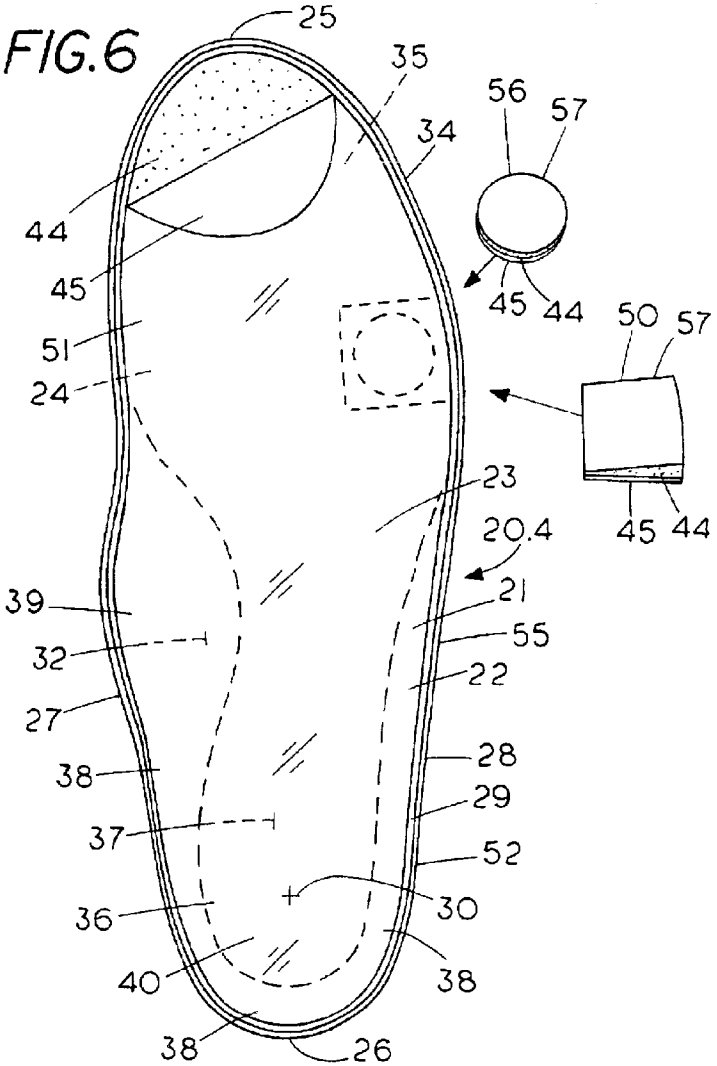
FIG. 6 is a bottom plan view of a full length conformable device including light cure material that is affixed to an overlaying sockliner.

FIG. 6 is a bottom plan view of a conformable device 20.4 that is made in full length. Again, the superior side of the conformable device can be affixed in function relation to the overlaying sockliner 34 portion by adhesive means such as by removing a peel-ply layer and exposing a self-adhesive surface, or welding, and the like. Also shown is the use of a removable peel-ply layer 45 that can expose a self-adhesive surface 44 on the inferior side 23 of the conformable device 20.4 for securing it in functional relation to the footbed of an article of footwear. Also shown is a correction device 57 such as a post 56 or wedge 50 including a self-adhesive surface 44 and a peel-ply layer 45 for possible application to the inferior side 23 of the conformable device 20.4 for accommodating, compensating, or correcting a wearer having anatomical structure or functional characteristics which might benefit from the use of a prescription orthotic device. For example, the correction device 57 such as a post 56 or wedge 50 could be applied to the medial side 27 of the midfoot area 55 or forefoot area 51 to compensate for a forefoot varus condition, or alternately, the correction device 57 such as a post 56 or wedge 50 could be applied to the lateral side 28 of the midfoot area 55 or forefoot area 51 to compensate for a forefoot valgus condition. Further, a correction device 57 such as a post 56 or wedge 50 can possibly be used in the rearfoot area 52 for correcting varus, valgus, and other structural or functional conditions that could benefit from the use of a prescription orthotic. It can be advantageous to use a full length conformable device 20.4 when orthotic correction with respect to the area of a wearer's forefoot 51 is required or desired.

Figure 7:
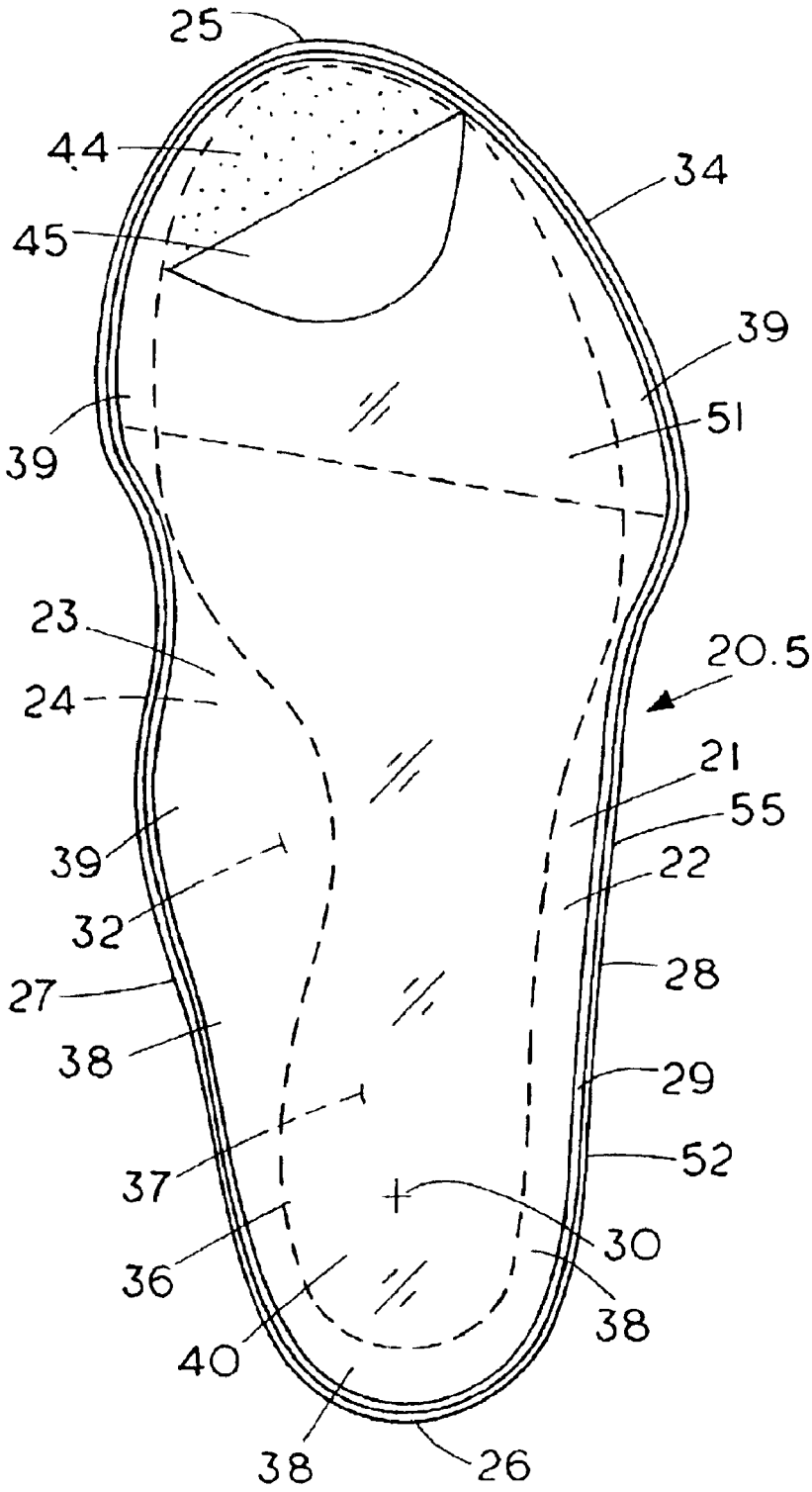
FIG. 7 is a bottom plan view of a full length conformable device including light cure material and appendages about the sides of the forefoot area that is affixed to an overlaying sockliner.

FIG. 7 is a bottom plan view of a conformable device 20.5 generally similar to that shown in FIG. 6, but further including appendages 39 on both the medial side 27 and lateral side 28 in the forefoot area 51 and including the area adjacent the approximate position of a wearer's first and fifth metatarsal-phalangeal joints, as shown by a generally transverse dashed line. This embodiment can be advantageous for use in an article of footwear 53 intended for use in lateral movement sports and activities such as soccer, basketball, and tennis.

Alternatively, it can be readily understood that a conformable device could comprise a more substantial portion of the midsole of an article of footwear specifically designed to accommodate the same. Accordingly, a more substantial quantity of light cure material could then be present under the heel or ball of a wearer's foot, or about the sides of their foot. A suitable light cure material for use in such an embodiment would generally comprise a resilient elastomeric material.

Figure 8:
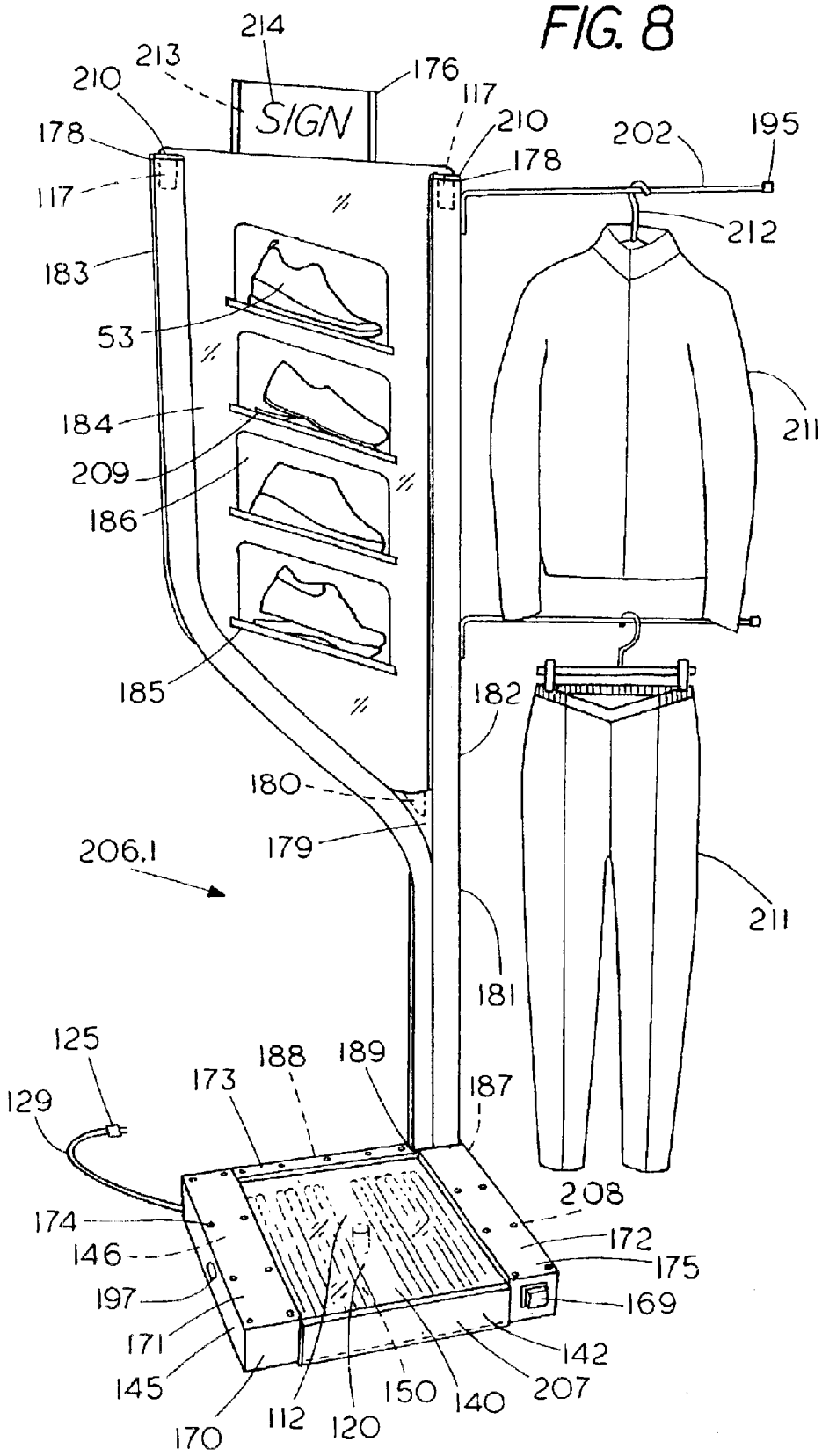
FIG. 8 is a front perspective view of a point of purchase display having a base including a light table.

FIG. 8 is a perspective view of a point of purchase display 206.1 including a light table 120 in the base 175 portion. As shown in FIG. 8, the base 175 portion of the point of purchase display 206.1 can include a front side 170, back side 188, bottom 146, left side 145, right side 208, a bumper 207 made of a non-slip material 142, an on/off switch 169, a left top cover 171, a right top cover 172, a middle top cover 173, a platform 112 including laminated auto glass 140, a light source 113 that can include a plurality of light bulbs or lamps 150, a plurality of fasteners or bolts 174, an electric power cord 129 including a plug 125.

As shown in FIG. 8, the vertical structure 181 of the point of purchase display 206.1 can include a right vertical member 182, and a left vertical member 183 which are combined and configured to form a v-shape generally resembling that of the spring element 209 possibly included in an article of footwear 53, as taught in co-pending Ser. No. 10/152,402, filed May 21, 2002. The inferior male projection 187 formed by the inferior ends of the combined vertical members 182 and 183 can be inserted into an inferior female receptacle 189 present in the base 175, and then be affixed with the use of bolts 190. The vertical structure 181 of the point of purchase display 206.1 can include a superior display 184 made of a substantially transparent thermoplastic or glass material. If the superior display 184 is made of thermoplastic material, then a polycarbonate or acrylic material can be used. Alternately, if it is desired to make the superior display of glass, a laminated glass similar to autoglass can be advantageous for use. The superior display 184 can include a plurality of apertures 186, and shelves 185 for supporting various articles of footwear 53. Accordingly, the articles of footwear 53 put upon display can be seen from both sides of the point of purchase display 206.1 and appear to be suspended in mid-air. The superior display 184 can include two superior male projections 177 for inserting into two superior female receptacles 178 that are present in the top portion of the right vertical member 182 and left vertical member 183, respectively. Further, the superior display 184 can include a middle male projection 180 for inserting into a middle female receptacle 179 located near the junction of the right vertical member 182 and left vertical member 183. Accordingly, the superior display 184 can simply be slipped downwards into place and be secured in functional relation to the right vertical member 182 and left vertical member 183 by inserting two locking caps 210 into the superior female receptacles 178 and also about the superior male projections 177 of the superior display 184. In brief, the point of purchase display 206.1 having a base 175 and also a vertical structure 181 including the superior display 184 can be quickly and easily assembled in just a few steps. The superior display 184 can include a superior sign retainer 176 that can include a pocket 213 for positioning a sign 214. Also shown are articles of apparel 211 on hangers 212 that are on display and hanging from the apparel rods 202. The proximal end of the apparel rods 202 can be removably inserted into the apparel rod receptacles 201, whereas the distal end can include a knob 195 for retaining at least one hanger 212. The apparel rods 202 can be swiveled as desired in various positions about the vertical structure 181.

Figure 9:
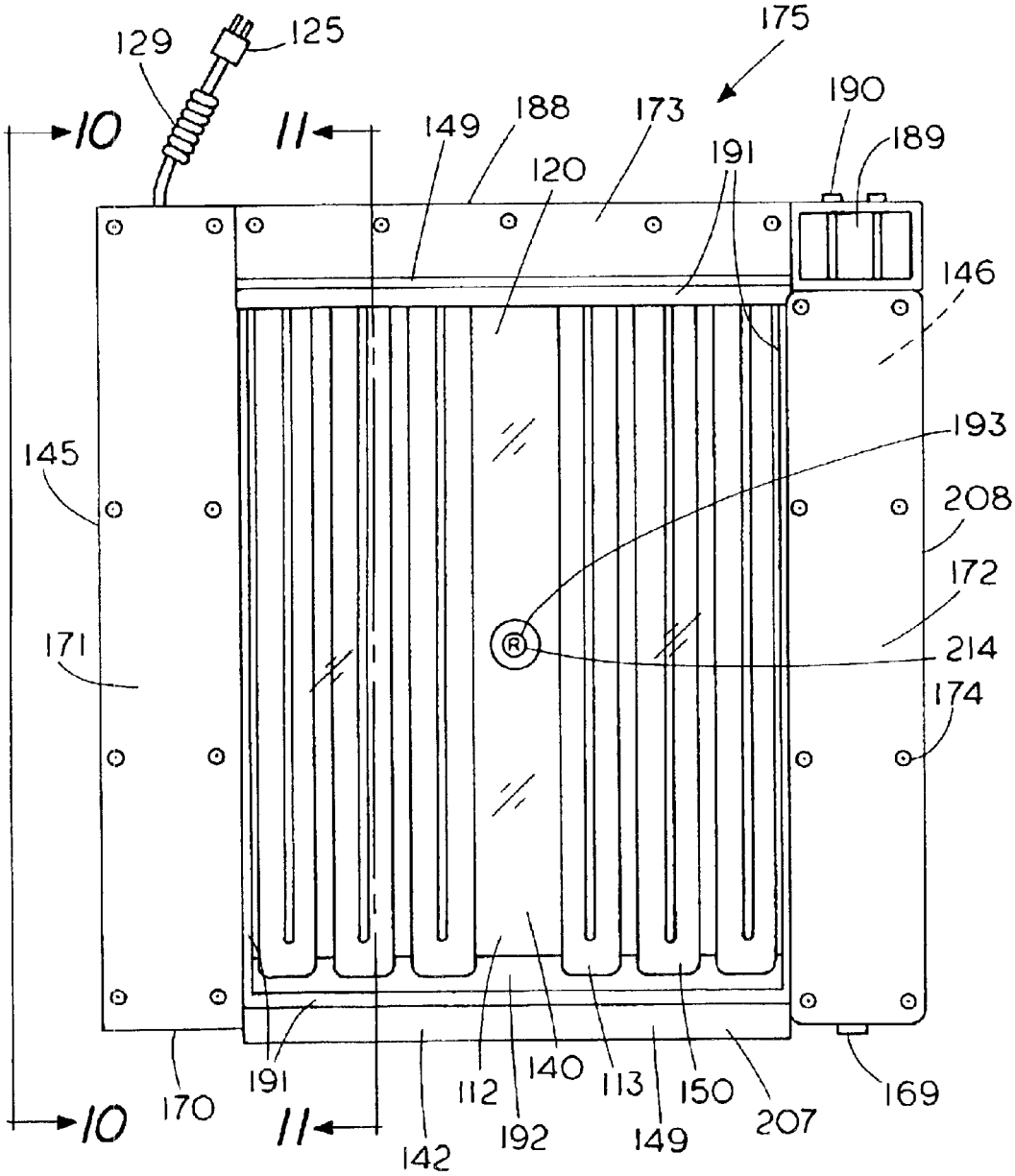
FIG. 9 is a top plan view of the base of the point of purchase display including a light table shown in FIG. 8.

FIG. 9 is a top plan view of the base 175 portion of the point of purchase display 206.1 including a light table 120 shown in FIG. 8. As shown in FIG. 9, the base 175 portion of the point of purchase display 206.1 can include a front side 170, back side 188, bottom 146, left side 145, right side 208, a bumper 207 made of a non-slip material 142, an on/off switch 169, a left top cover 171, a right top cover 172, a middle top cover 173, a ledge 191 and center support 193 for supporting a platform 112 including laminated auto glass 140, a light source 113 including a plurality of light bulbs or lamps 150 supported by a light support 192, a plurality of fasteners or bolts 174, a inferior female receptacle 189 and bolts 190 for securing a vertical structure 181, and an electric power cord 129 including a plug 125.

Figure 10:
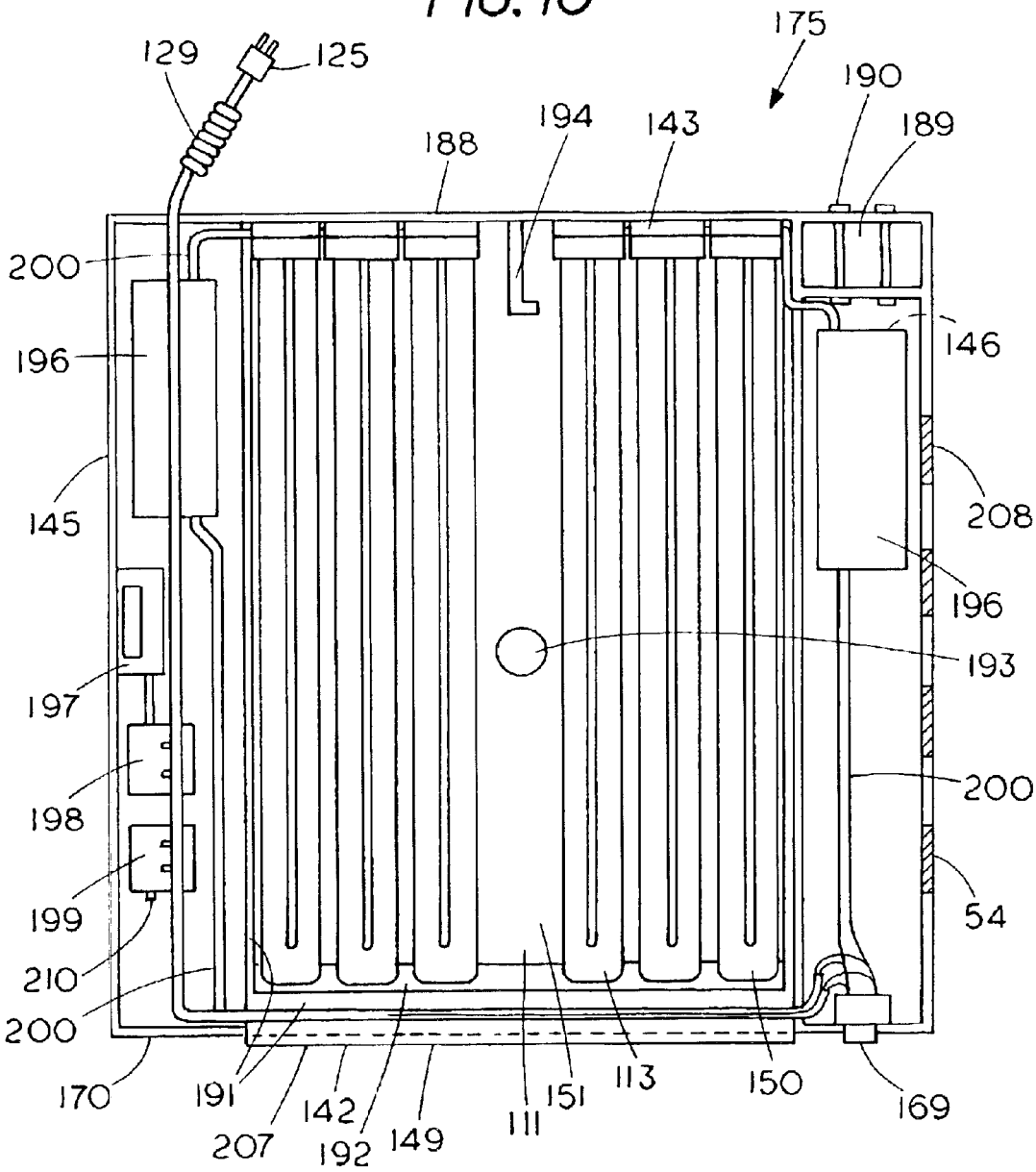
FIG. 10 is a cross-sectional top plan view taken along line 10—10 of the base of the point of purchase display including a light table shown in FIG. 9, thus revealing its internal structure and components.

FIG. 10 is a cross-sectional top plan view taken along line 10—10 of the base 175 of the point of purchase display 206.1 including a light table 120 shown in FIG. 9, thus revealing its internal structure and components. As shown in FIG. 10, the base 175 portion of the point of purchase display 206.1 can include a front side 170, back side 188, bottom 146, left side 145, right side 208, a bumper 207 made of a non-slip material 142, an on/off switch 169, a ledge 191 and a center support 193 for supporting a platform including laminated auto glass, a light source 113 that can include a plurality of light sockets 143 for receiving a plurality of light bulbs or lamps 150, a light support 192, a brace 194, a reflector 151 including a reflective material 111, an inferior female receptacle 189 and bolts 190 for securing vertical structure 181, at least one ballast 196, a fan 197, a transformer 198, an impedance switch 199, electric wire 200, and an electric power cord 129 including a plug 125. If desired, when the selector switch 210 on the impedance switch 199 is placed in the "on" position, the light source 113, e.g., possibly including light bulbs or lamps 150, can be turned on for a predetermined length of time by an individual simply touching the platform 112 associated with the light table 120 and base 175.

Figure 11:
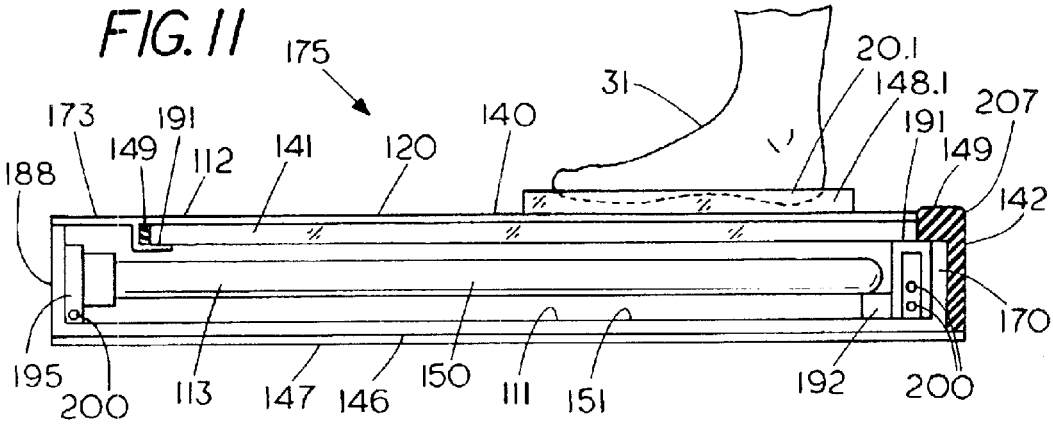
FIG. 11 is a side cross-sectional view taken along line 11—11 of the base of the point of purchase display including a light table shown in FIG. 9, thus revealing its internal structure and components.

FIG. 11 is a side cross-sectional view taken along line 11—11 of the base 175 of the point of purchase display 206.1 including a light table 120 shown in FIG. 9, thus revealing some of its internal structure and components. Broadly defined, a light table constitutes a support surface capable of transmitting or emitting a suitable source of light for effecting the cure of a light cure material and making a conformable device. An individual can then sit or stand in functional relation to a substantially transparent, translucent, or illuminated support surface 112 and cause a force application to be made by a portion of their foot 31 upon a conformable device 20.1, or the like, thereby causing it to be molded to the shape of a portion of their foot 31. As shown in FIG. 11, and as generally preferred, the support surface 112 of a light table 120 can be planar or flat. A flat support surface 112 can be advantageous for use when making orthotics. A wearer's foot 31 is shown making a force application upon a conformable device 20.1 that is positioned upon a last configuration support 148.1 A wearer can either stand or sit with their foot 31 in position on a conformable device 20.1, as desired. One or the other position can be advantageous when orthotics are being made depending upon an individual's anatomical configuration and functional characteristics, or anomalies. It can be advantageous that a conformable device be specifically designed and caused to set and cure in a shape corresponding to the specific last shape and interior of the article of footwear in which it will be used. A suitable conformable device can then vary in design, configuration and dimensions depending upon the targeted footwear application.

Further, as taught in U.S. Pat. No. 5,632,057 granted to the applicant, this patent being previously incorporated by reference herein, a podiatrist, physical therapist, or other qualified medical specialist can place a wearer's foot in or about the neutral position, and affix one or more correction devices such as posts or wedges including the required degree of correction to the inferior side of a conformable device 20.1, and the like, and thereby quickly make a custom prescription orthotic. For example, a correction device such as a post or wedge can be affixed in an area corresponding to a wearer's heel, midfoot, or forefoot, as desired or required, in conjunction with conformable device in order to correct podiatric deviations that would fall outside the norm, e.g., potential or actual injurious conditions of eversion or pronation, inversion or supination, varus, and valgus. Further, the correction device such as a post or wedge can be manufactured to specific degrees of correction and also for the article of footwear in which the application is to be made. A protective peel-ply backing can be removed from the correction device such as a post or wedge to expose a self-adhesive surface for securing the correction device such as a post or wedge in place. The introduction of such correction devices or orthotics should be undertaken at the direction and with the supervision of a skilled and knowledgeable podiatrist, physical therapist, or other medical professional.

When a conformable device is being used by a medical professional to provide a prescription orthotic device, it can be advantageous for a wearer to remain relatively inactive while the light cure material is being caused to cure, and in particular, when a light cure material having a relatively short working or cure time is being used. Given wearers having normal structure and functional anatomy, it is generally advantageous to form the conformable device with the wearer maintaining a standing position in order to better accommodate for flexion of the wearer's arches and general deformation of the foot. However, it is often advantageous for individuals requiring prescription orthotics to form a conformable device in a sitting position while making a lesser force application thereupon. Whether a conformable device be formed in a standing or sitting position, the alignment of the wearer's leg and foot should generally correspond to the neutral position, that is, the lower leg or tibia should be in line with the heel or calcaneus, and both should be approximately perpendicular to the surface upon which the article of footwear rests. In a standing position, the knee and ankle joints should not be substantially flexed, and the alignment of the knee or patella with respect to the foot should be such that it is roughly in line with the middle of the forefoot. The conditions of pronation or supination can thereby be reduced or avoided.

Figure 12:
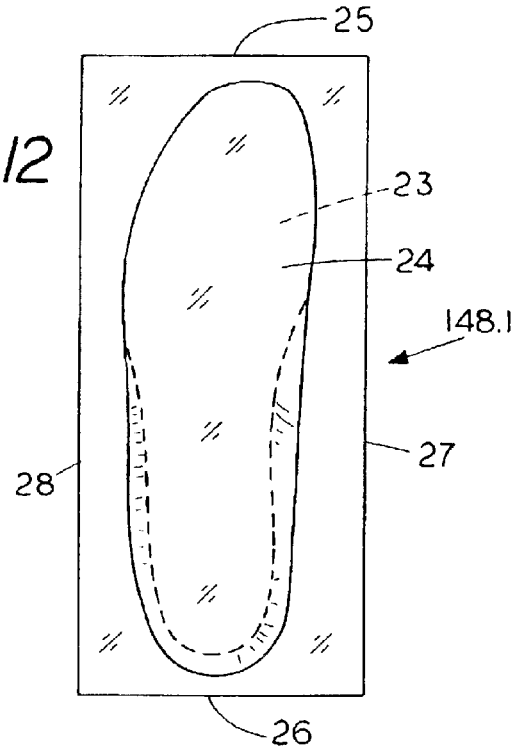
FIG. 12 is a top plan view of a last configuration support generally similar to that shown in FIG. 11.
Figure 13:
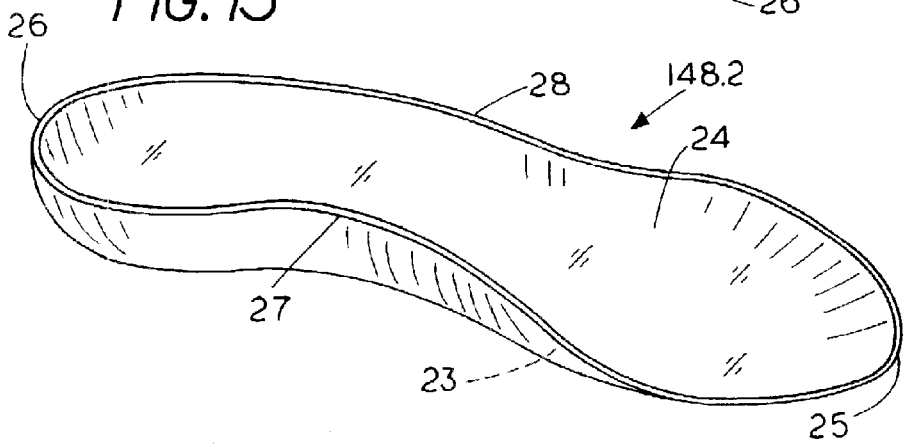
FIG. 13 is a perspective view of an alternate last configuration support.

Alternately, the support surface 112 of a light table 120 can be curved instead of planar or flat, or have a complex three dimensional shape. More specifically, when various articles of footwear 53 having different shaped contoured footbeds will be used, different support surfaces 112 having different matching contours can then be used. Accordingly, when a conformable device 20.1, and the like, will be fitted in functional relation to an article of footwear 53 having a contoured footbed, the support surface 112 can incorporate like contours for facilitating proper mating of the conformable device 20 with a given article of footwear 53. However, when articles of footwear 53 having different shaped contoured footbeds will be used, it can be most advantageous and is preferred to make and use an additional last configuration support 148.1 or 148.2 including the desired contours with a support surface 112 that is planar or flat, as shown in FIGS. 11–13.

The support surface 112 can be made of glass, such as quartz glass, PYREX®, or STARFIRE® glass made by PPG Industries, tempered glass, laminated auto glass, and the like. Alternately, the support surface 112 can be made of a plastic material, e.g., an acrylic material such as CYROLON®, or a polycarbonate material such as ACRYLITE® made by Cyro, Industries of Mt. Arlington, N.J., and the like. As compared with glass, a plastic acrylic or polycarbonate material, and the like, can be lighter, less expensive, easier to cut or shape, and relatively unbreakable. However, plastic transparent materials of this general type in one quarter or one half inch thickness commonly transmit only approximately 88–95 percent of the available light, whereas glass can approach 100 percent light transmission. Glass lacks the strength and light weight of plastic materials such as acrylic or polycarbonate, whereas the latter plastic materials can be easily scuffed and scratched relative to glass. Accordingly, it can be advantageous to use a piece of plastic material 141, e.g., acrylic or polycarbonate material, in making the inferior portion of the support surface 112. A piece of laminated auto glass 140 can then be used for the superior portion of the support surface 112. The laminated auto glass 140 can provide scuff resistance, and if ever broken will substantially remain in one piece. The laminated auto glass 140 can be held in position upon the plastic material 141 used to make the inferior portion of the support surface 112 by mechanical means such as retainer 149 about a portion of the perimeter of the laminated auto glass 140. It can be advantageous for the retainer 149 to include or consist of a non-slip material 142. The support surface 112 can thereby be affixed in functional relation to the light table 120 in such a manner as to facilitate easy removal and replacement of used light bulbs or lamps 150.

The light table 120 can include a fan 197 and ventilation means such as openings or vents 54 in order to facilitate the maintenance of a desired range of operating temperature. The light table 120 can include a reflector 151 made of a reflective material 111 in order to increase the exhibited light power and efficiency of the light table 120. In this regard, aluminum or silver reflective metal materials made by Reliance Amalco of Union City, Calif. can be used. A resilient pad 147 capable of providing shock and vibration isolation and providing a non-slip inferior surface can be affixed to the bottom 146 of the light table. The light table 120 can include a plurality of light sources 113, such as fluorescent light bulbs or lamps 150 and electrical components which are essential to their proper operation, such as ballasts, light sockets 143, and switches. An manual or automatic impedance switch 199 can be used to turn the light source 113 on and off. An impedance switch 199 can turn on the lamps the instant a wearer steps upon or touches the light table 120. Inclusion of an associated electronic timing device can turn the light source 113 on and off when the desired or engineered cure time has elapsed. Alternately, power switches that are activated by sound, motion, or remote control can also be used as desired.

Again, a light source 113 can be activated causing the light cure material 37 contained within a conformable device 20.1, and the like, to set and cure. Advantageous light sources 113 for use include fluorescent light bulbs or lamps 150 having substantial power in the blue portion of the visible light spectrum such as "Daylight/6500K," "Colortone 50/5000K," "Colortone 75/7500K," "Actinic" or "SuperActinic," and in particular, "Special Blue" fluorescent light bulbs made by the Phillips Lighting Company of Somerset, N.J. However, the preferred fluorescent light bulb or lamp 150 for use having exceptional brightness and sufficient spectral power in the blue portion of the light spectrum is General Electric's BIAX® F40/30BX/SPX50. A light source 113 including a plurality of these lamps 150 has demonstrated cure of light cure materials 37 having greater than one quarter inch depth in less than one minute. It can be especially advantageous to use a light source 113 consisting of fluorescent light bulbs or lamps 150, as they operate at relatively low temperatures and are energy efficient.

Alternately, provided that substantial force would not be directly applied to a cathode ray tube, projection surface, or liquid crystal display, which are commonly used, e.g., in the making of television or computer screens, it is also possible for these devices to serve as a light source. Further, a select color of visible light, trademark, and relevant technical information and advertising can then be provided on the screen. In addition, it can be readily understood that a light table 120 can be inclined from the horizontal, and built into a console. Moreover, it is possible for a support surface 112 to simultaneously constitute a light source 113.

FIG. 12 is a top plan view of a last configuration support 148.1 generally similar to that shown in FIG. 11 showing the anterior side 25, posterior side 26, medial side 27, lateral side 28 superior side 24 and inferior side 23. A last configuration support 148.1 and 148.2 can be formed in a complimentary shape corresponding to a particular footwear last size and configuration. Accordingly, when a conformable device 20.1, or the like, is placed in functional relation to a last configuration support 148.1 or 148.2, and a wearer's foot is positioned thereupon, and a conformable device 20.1, or the like, is caused to set and cure, the resulting shape formed on the side opposite the wearer's foot 31 will substantially conform to the shape of the inside of an article of footwear 53 that has been made upon the corresponding footwear last, or like three dimensional shape, pattern, or rendering. The last configuration support 148.1 can be made of glass, such as quartz glass, PYREX®, STARFIRE® glass made by PPG Industries, tempered glass, laminated auto glass, and the like. Alternately, the last configuration support 148.1 can be made of a plastic material, e.g., an acrylic material such as CYROLON®, or a polycarbonate material such as ACRYLITE® made by Cyro, Industries of Mt. Arlington, N.J., and the like. The preferred last configuration support 148.1 is made from a scratch resistant polycarbonate material.

FIG. 13 is a perspective view of an alternate last configuration support 148.2 showing the anterior side 25, posterior side 26, medial side 27, lateral side 28 superior side 24 and inferior side 23. The last configuration support 148.2 has a relatively thin cross-sectional thickness and includes curved contours about a portion of the medial side 27, lateral side 28 and posterior side 26. The last configuration support 148.2 can be made of glass, such as quartz glass, PYREX®, STARFIRE® glass made by PPG Industries, tempered glass, laminated auto glass, and the like. Alternately, the last configuration support 148.2 can be made of a plastic material, e.g., an acrylic material such as CYROLON®, or a polycarbonate material such as ACRYLITE® made by Cyro, Industries of Mt. Arlington, N.J., and the like. The preferred last configuration support 148.2 is made from a scratch resistant polycarbonate material.

Figure 14:
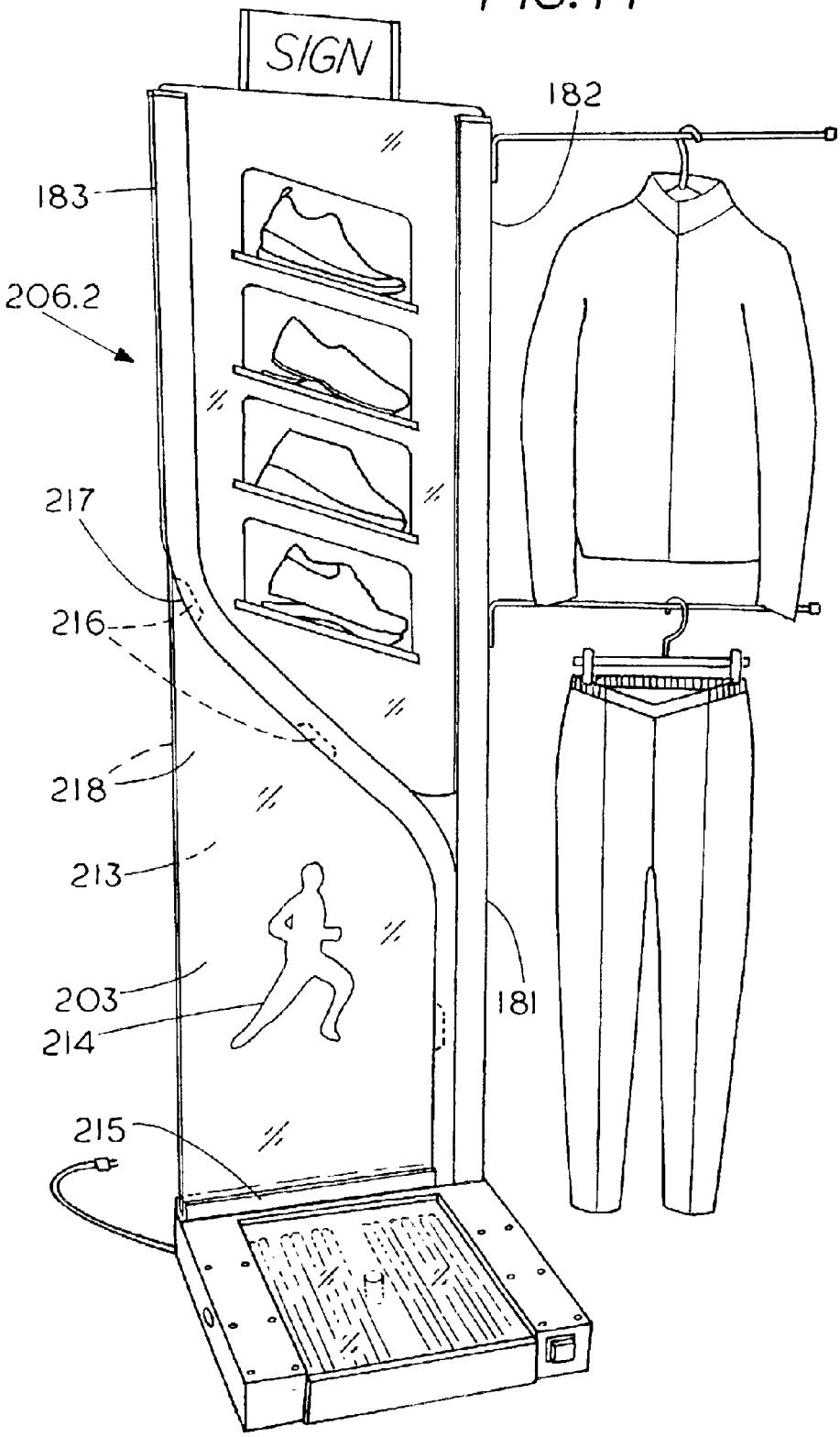
FIG. 14 is a perspective view of an alternate point of purchase display having a base including a light table, but also an inferior sign retainer.

FIG. 14 is a perspective view of an alternate point of purchase display 206.2 including a light table 120 generally similar to that shown in FIG. 8. However, the point of purchase display 206.2 further includes an inferior sign retainer 203 including a tray 215 for securing the inferior portion of at least one panel 218. The panel 218 can include male projections 216 for mating with female receptacles 217 that can secure the right side and superior side of the panel 218 in function relation to the vertical structure 181, and in particular, the left vertical member 183. The panel 218 can be made of safety glass, such as tempered glass, or laminated auto glass, and the like. Alternately, the panel 218 can be made of a plastic material, e.g., an acrylic material such as CYROLON®, or a polycarbonate material such as ACRYLITE® made by Cyro, Industries of Mt. Arlington, N.J., and the like. As shown, the panel 118 can consist of two parallel sheets of glass or plastic material forming a pocket 213 therebetween, whereby a sign 214 can be removably affixed. The preferred panel 118 is made from a scratch resistant acrylic or polycarbonate material.

FIG. 15 is a perspective view of another alternate point of purchase display 206.3 including a light table 120. This point of purchase display 206.3 includes a pegboard 204 into which hooks 205 can be placed for displaying merchandise such as various conformable devices. The pegboard 204 can be secured in position using a tray 215 and male projections 216 and female receptacles 217 similar to those shown in FIG. 14. Shown is a container 223 consisting of a plastic bag 212 including a barrier material 130 with respect to visible light that serves to contain and protect a conformable device 20.1.

Figure 16:
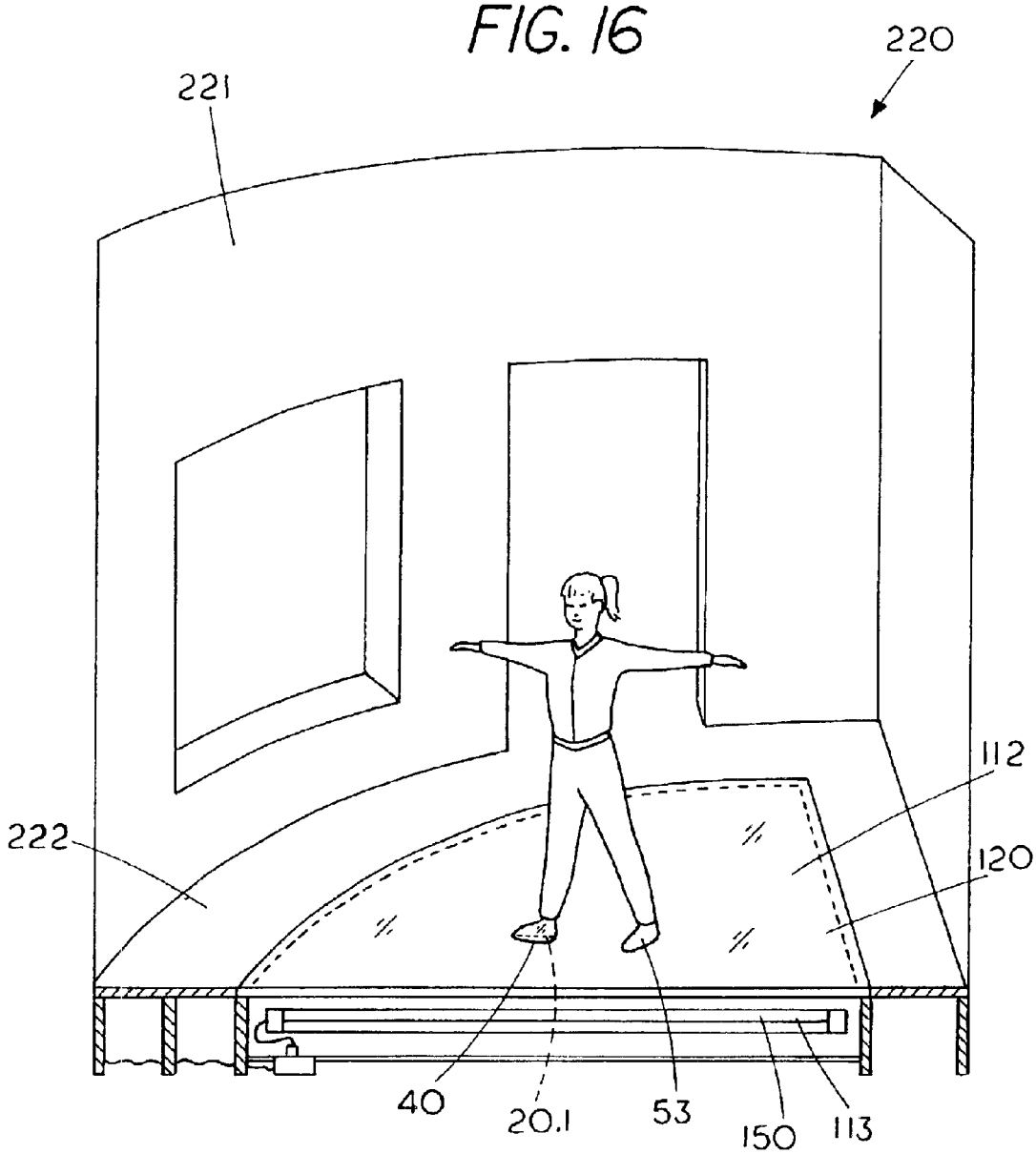
FIG. 16 is a perspective view of a room in a retail store including a light table that is built into the floor.

FIG. 16 shows a room 221 in a retail store 220 including a floor 222 that includes a built-in light table 120. The platform 112 of a light table 120 can be elevated relative to a floor 222 or surrounding support surface, or alternately, can be built into the floor 222 so that the top of the platform 120 is approximately level with and serves as a portion of the floor 222, as shown in FIG. 16. The support surface or platform 112 provided by the floor can consist of substantially transparent glass or plastic material. A plurality of light sources 113 possibly including light bulbs or lamps 150 can be positioned beneath the platform 112. The light sources 113 positioned in the floor could alternately constitute an array of television screens, or otherwise be part of a larger display capable of illumination and projecting suitable light for causing the light cure material 37 in a conformable device 20.1, and the like, to set and cure.

A wearer could then walk about the room 222 with a conformable device 20.1 and overlaying sockliner 34 positioned in a slipper or article of footwear 53 having a sole made of a substantially transparent material 40 and the conformable device 20.1 can be caused to set and cure. In this regard, it can be advantageous to effect light cure with a conformable device 20.1 positioned in functional relation to an article of footwear 53 that is made according to the same last, or that otherwise has the same interior shape as the article of footwear in which the conformable device 20.1 will be used. In particular, this can provide conformance with portions of a wearer's anatomy while simultaneously mating the conformable device 20.1 to the interior of the article of footwear 53. When possible, and as taught in the applicant's U.S. Pat. No. 5,632,057, previously incorporated by reference herein, it can also be advantageous to effect light cure of a conformable device 20.1 within the particular article of footwear that is intended for use by a wearer.

For the sake of clarity, various embodiments and features of the present invention have sometimes been treated independently. Further, the applicant's U.S. Pat. No. 5,632,057 has also been incorporated by reference herein. However, it can be readily understood that alternate embodiments of the present invention for use with articles of footwear could include a plurality and/or various combinations of the embodiments and features recited and incorporated by reference herein. It can be appreciated that the present invention provides a relatively simple, but effective means for enhancing the conformance or fit, support, stability, comfort, and cushioning provided by articles of footwear. Moreover, the present invention anticipates a wide range of possible applications and the need to accommodate unique individual differences.

While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

213 Pocket
214 Sing
215 Tray
216 Male Projection
217 Female Receptional
218 Panel
219 Pegboard
220 Retail Store
221 Room
222 Floor
223 Container

I claim:

1. A method for making a conformable device for use with an article of footwear comprising the steps of:

a) placing a conformable device including a light cure material which is capable of being cured when exposed to visible light upon a platform of a light table which is capable of providing said light, said light table comprising a light source positioned in functional relation thereto which is capable of irradiating at least a substantial inferior portion of said conformable device when said conformable device is positioned upon said platform;

b) placing the foot of a wearer upon said conformable device, thereby causing a force application to be made thereupon and causing at least a portion of said conformable device to be formed in conformance with at least a portion of said foot; and c) activating said light source to cause the cure of said light cure material, thereby causing the shape imparted to the conformable device by said foot to be substantially retained.

2. The method according to claim 1, comprising the further step of:

d) removing a barrier material with respect to said visible light from about said conformable device prior to placing said conformable device upon said platform.

3. The method according to claim 1, comprising the further step of:

d) placing said foot in approximately a neutral position upon said conformable device prior to causing said light cure material to cure, and retaining said foot in said neutral position upon said conformable device while causing said light cure material to cure.

4. The method according to claim 1, comprising the further step of:

d) placing said foot in approximately a neutral position upon said conformable device prior to causing said light cure material to cure, and adding a correction device with respect to said wearer's anatomy to said conformable device for substantially maintaining said neutral position, and retaining said foot in said neutral position upon said conformable device while causing said light cure material to cure.

5. The method according to claim 4, wherein said correction device comprises a wedge.

6. The method according to claim 1, comprising the further step of:

d) affixing said conformable device in functional relation to an overlaying sockliner prior to placing said conformable device upon said platform of said light table.

7. The method according to claim 1, wherein said light table comprises a vertical structure including means for supporting and displaying at least one article of footwear comprising a conformable device.

8. The method according to claim 7, wherein said vertical structure further comprises a left vertical member and a right vertical member, each including said means for supporting and displaying.

9. The method according to claim 7, wherein said means for supporting and displaying said at least one article of footwear comprises a superior display including at least one shelf.

10. The method according to claim 7, wherein said vertical structure further comprises at least one sign retainer.

11. The method according to claim 7, wherein said vertical structure further comprises a sign.

12. The method according to claim 7, wherein said vertical structure further comprises a pegboard.

13. The method according to claim 12, wherein said pegboard accommodates at least one hook for hanging and displaying a container including a conformable device.

14. The method for making a conformable device for use with an article of footwear according to claim 1, wherein said platform of said light table comprises a substantially transparent last configuration support having a complimentary shape corresponding to a last size and configuration of a last of said article of footwear.

15. A method for making a conformable device for use with an article of footwear comprising the steps of:

a) placing a conformable device including a light cure material which is capable of being cured when exposed to visible light upon a substantially transparent last configuration support having a complimentary shape corresponding to a size and configuration of a last of said article of footwear, and positioning said last configuration support on the platform of a light table which is capable of providing said light, said light table comprising a light source positioned in functional relation thereto which is capable of irradiating at least a substantial inferior portion of said conformable device when said conformable device is positioned on said last configuration support, and said last configuration support is positioned upon said platform;

b) placing the foot of a wearer upon said conformable device, thereby causing a force application to be made thereupon and causing at least a portion of said conformable device to be formed in conformance with at least a portion of said foot and also at least a portion of said last configuration support; and c) activating said light source to cause the cure of said light cure material, thereby causing the shape imparted to the conformable device by said foot to be substantially retained.

16. The method according to claim 15, comprising the further step of:

d) removing a barrier material with respect to said light from about said conformable device prior to placing said conformable device upon said last configuration support.

17. The method according to claim 15, comprising the further step of:

d) placing said foot in approximately a neutral position upon said conformable device prior to causing said light cure material to cure, and retaining said foot in said neutral position upon said conformable device while causing said light cure material to cure.

18. The method according to claim 15, comprising the further step of:

d) placing said foot in approximately a neutral position upon said conformable device prior to causing said light cure material to cure, and adding a correction device with respect to said wearer's anatomy to said conformable device for substantially maintaining said neutral position, and retaining said foot in said neutral position upon said conformable device while causing said light cure material to cure.

19. The method according to claim 18, wherein said correction device comprises a wedge.

20. The method according to claim 15, comprising the further step of:

d) affixing said conformable device in functional relation to an overlaying sockliner prior to placing said conformable device upon said last configuration support.

21. The method according to claim 15, wherein said last configuration support comprises a substantially transparent plastic material.

22. The method according to claim 15, wherein said last configuration support comprises a substantially transparent glass material.

23. A method for making a conformable device for use with an article of footwear comprising the steps of:

a) placing a conformable device comprising a light cure material which is capable of being cured when exposed to visible light within an article of footwear which is capable of transmitting said light to a substantial portion of said conformable device;

b) placing the foot of a wearer in functional relation to said conformable device, thereby causing a force application to be made thereupon and causing at least a portion of said conformable device to be formed in conformance with at least a portion of said foot; and c) exposing said article of footwear including said conformable device to said visible light to cause the cure of said light cure material, thereby causing the shape imparted to the conformable device by said foot to be substantially retained.

24. The method according to claim 23, comprising the further step of:

d) removing a barrier material with respect to said visible light from about said conformable device prior to placing said conformable device within said article of footwear.

25. The method according to claim 23, comprising the further step of:

d) placing said foot in approximately a neutral position upon said conformable device prior to causing said light cure material to cure, and retaining said foot in said neutral position upon said conformable device while causing said light cure material to cure.

26. The method according to claim 23, comprising the further step of:

d) placing said foot in approximately a neutral position upon said conformable device prior to causing said light cure material to cure, and adding a correction device with respect to said wearer's anatomy to said conformable device for substantially maintaining said neutral position, and retaining said foot in said neutral position upon said conformable device while causing said light cure material to cure.

27. The method according to claim 26, wherein said correction device comprises a wedge.

28. The method according to claim 23, comprising the further step of:

d) affixing said conformable device in functional relation to an overlaying sockliner prior to placing said conformable device within said article of footwear.

29. The method according to claim 23, wherein said visible light is provided by a light table.

30. The method according to claim 23, wherein said visible light is provided by a light table which comprises the floor of a retail store.

* * * * *